US008160801B2

(12) United States Patent
Ezaki et al.

(10) Patent No.: US 8,160,801 B2
(45) Date of Patent: Apr. 17, 2012

(54) VALVE DRIVE SYSTEM AND VALVE DRIVING METHOD

(75) Inventors: Shuichi Ezaki, Susono (JP); Manabu Tateno, Shizuoka-ken (JP); Akio Kidooka, Kanagawa-ken (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 879 days.

(21) Appl. No.: 12/293,465

(22) PCT Filed: Mar. 20, 2007

(86) PCT No.: PCT/IB2007/000698

§ 371 (c)(1),
(2), (4) Date: Sep. 18, 2008

(87) PCT Pub. No.: WO2007/107857

PCT Pub. Date: Sep. 27, 2007

(65) Prior Publication Data

US 2009/0272351 A1 Nov. 5, 2009

(30) Foreign Application Priority Data

Mar. 20, 2006 (JP) ..... 2006-076433
Oct. 16, 2006 (JP) ..... 2006-281455

(51) Int. Cl.

| | |
|---|---|
| ***G06F 19/00*** | (2011.01) |
| ***F01L 1/34*** | (2006.01) |
| ***F01L 9/04*** | (2006.01) |
| ***F02D 13/02*** | (2006.01) |

(52) U.S. Cl. ..... 701/103; 701/110; 123/90.11; 123/90.17; 123/348

(58) Field of Classification Search ..... 701/101–104, 701/110; 123/90.1, 90.11, 90.15–90.18, 123/90.27, 90.31, 90.6, 316, 347, 348, 402, 123/403

See application file for complete search history.

(56) References Cited

U.S. PATENT DOCUMENTS 6,553,951 B2 * 4/2003 Ogawa ..... 123/90.17

(Continued)

FOREIGN PATENT DOCUMENTS

DE 101 37 072 A1 2/2003

(Continued)

OTHER PUBLICATIONS

Notice of Grounds for Rejection dated Jun. 7, 2010 for KR 10-2008-7022865.

(Continued)

*Primary Examiner* — Willis Wolfe, Jr.
(74) *Attorney, Agent, or Firm* — Finnegan, Henderson, Farabow, Garrett & Dunner, LLP

(57) ABSTRACT

A valve drive system comprises a power transmitting mechanism (13) that converts rotary motion of an electric motor (12) into opening and closing motion of an intake valve (3) provided in a cylinder (2) of an internal combustion engine (1) to transmit power from the electric motor (12) to the valve (3) via a cam (152); and a rotational angle restricting mechanism (16) that is provided in a motion transmission path that extends from the electric motor (12) to the cam (152) and restricts rotation of the cam (152) within a predetermined angular range that is set so that a piston (5) of the engine (1) and the intake valve (3) do not interfere with each other. The rotational angle restricting mechanism (16) comprises a flange (161) that rotates as a unit with a camshaft (151) and forms a slotted groove hole (161*a*) thereon; and a stopper pin (162) that is inserted into and retracted from the groove hole (161*a*).

34 Claims, 13 Drawing Sheets

U.S. PATENT DOCUMENTS

| | | | | |
|---|---|---|---|---|
| 7,111,599 | B2 * | 9/2006 | Asada et al. | 123/90.16 |
| 7,290,511 | B2 * | 11/2007 | Tashiro | 123/90.16 |
| 7,367,297 | B2 * | 5/2008 | Tashiro | 123/90.16 |
| 7,588,003 | B2 * | 9/2009 | Tashiro | 123/90.16 |
| 2003/0051688 | A1 | 3/2003 | Chang et al. | |
| 2004/0107928 | A1 * | 6/2004 | Asada et al. | 123/90.16 |

FOREIGN PATENT DOCUMENTS

| | | | |
|---|---|---|---|
| DE | 101 40 461 | | 2/2003 |
| EP | 1 426 568 | A1 | 6/2004 |
| JP | 07-332129 | | 12/1995 |
| JP | 08-128341 | | 5/1996 |
| JP | 10-030415 | | 2/1998 |
| JP | 2000-303812 | | 10/2000 |
| JP | 2004-183611 | | 7/2004 |
| JP | 2004-183612 | | 7/2004 |
| JP | 2004-257313 | | 9/2004 |
| JP | 2004-340019 | | 12/2004 |
| JP | 2004-538417 | | 12/2004 |
| JP | 2005-54732 | | 3/2005 |
| JP | 2005-069147 | | 3/2005 |
| JP | 2006-083819 | | 3/2006 |
| WO | WO 02/053881 | A1 | 7/2002 |
| WO | WO 2004/044392 | A1 | 5/2004 |
| WO | WO 2005-119019 | | 12/2005 |

OTHER PUBLICATIONS

Office Action entitled "Notification of Reasons for Refusal" from the Japanese Patent Office issued on Jul. 21, 2009, for JP 2006-281455.

* cited by examiner

VALVE DRIVE SYSTEM AND VALVE DRIVING METHOD

CROSS-REFERENCE TO RELATED APPLICATIONS

This application is a national phase application of International Application No. PCT/IB2007/000698, filed Mar. 20, 2007, and claims the priority of Japanese Application Nos. 2006-076433, filed Mar. 20, 2006, and 2006-281455, filed Oct. 16, 2006, the contents of all of which are incorporated herein by reference.

BACKGROUND OF THE INVENTION

1. Field of the Invention

The invention relates to a valve drive system that uses an electric motor for driving valves provided in cylinders of an internal combustion engine, and also relates to a method of driving the valves.

2. Description of the Related Art

As one type of valve drive systems, a valve drive system that uses an electric motor for driving (i.e., opening and closing) valves provided in cylinders of an internal combustion engine is widely known. In the valve drive system of this type, it is necessary to synchronize rotation of the crankshaft and rotation of cams with high accuracy, from the viewpoint of avoiding interference between pistons and the valves. JP-A-2005-054732 discloses a valve drive system that interrupts or cuts off power transmission to the valves so as to stop opening and closing motion of the valves when synchronism between the crankshaft and the cams is lost for some reason, namely, when rotation of the crankshaft and rotation of the cams are out of synchronism. JP-A-2005-054732 also discloses a valve drive system in which cams that provide a high valve lift and cams that provide a low valve lift are prepared, and the low-lift cams are used in place of the high-lift cams when the crankshaft and the cams are out of synchronism, so that the lift amounts of the valves can be reduced.

In the system as disclosed in JP-A-2005-054732, the low-lift cams for reducing the lift amounts of the valves must be prepared, and a mechanism for switching from the high-lift cams to the low-lift cams must be provided. Also, there is a need to provide a mechanism that interrupts transmission of power to the valves so as to stop opening and closing motion of the valves. Thus, the system of JP-A-2005-054732 may suffer from increased complexity in construction and increased cost.

In some cases, the range of movements of the valves needs to be restricted irrespective of whether the rotation of the crankshaft and the rotation of the cams are in or out of synchronism with each other. If the system of JP-A-2005-054732 is employed in such cases, the range of movements of the valves may be restricted, but the cams can freely rotate by themselves, thus allowing the electric motor to continue rotating. Therefore, if any abnormality occurs to a motor driving system that extends from the electric motor to the valves, the abnormality may become more serious as the motor keeps rotating.

SUMMARY OF THE INVENTION

It is therefore the first object to provide valve drive system and valve driving method that can mechanically restrict rotation of cams. It is the second object of the invention to provide valve drive system and valve driving method that can prevent interference between pistons and valves by restricting rotation of the cams.

The first aspect of the invention concerns a valve drive system which includes a power transmitting mechanism that converts rotary motion of an electric motor into opening and closing motion of a valve provided in a cylinder of an internal combustion engine to transmit power from the electric motor to the valve via a cam, and a rotational angle restricting mechanism that is provided in a motion transmission path that extends from the electric motor to the valve, and restricts rotation of the cam within a predetermined angular range that is narrower than an angular range in which the cam provides the maximum lift of the valve. The first aspect of the invention also concerns a method of driving the valves in the manner as described above.

In the valve drive system and valve driving method as described above, the rotational angle restricting mechanism can mechanically restrict the rotational angle of the cam within the predetermined angular range that is narrower than the range in which the cam provides the maximum lift of the valve. With the rotational angle thus restricted, the cam cannot rotate freely, and, therefore, the electric motor is prevented from continuing rotating to an excessive extent. The predetermined angular range may be any range provided that it is narrower than the range in which the valve reaches the maximum lift. Thus, restricting the rotational angle within the predetermined angular range may include inhibiting the cam from moving by means of the rotational angle restricting mechanism, in other words, stopping the rotating cam by means of the rotational angle restricting mechanism.

The construction of the rotational angle restricting mechanism is not limited to any particular construction provided that the mechanism can mechanically restrict rotation of the cam. For example, the rotational angle restricting mechanism may include a rotation limiter provided in a rotating member disposed in the motion transmission path such that the rotation limiter is located at the radially outer side from a center of rotation of the rotating member, and a movable member that moves between a restricting position at which the movable member interferes with a passage range of the rotation limiter and a non-restricting position at which the movable member is located away from the passage range of the rotation limiter. Also, in the case where the power transmitting mechanism includes an intervening member, such as a valve lifter or a rocker arm, which is interposed between the cam and the valve and moves in synchronization with the opening and closing motion of the valve, the rotational angle restricting mechanism may include a motion limiter provided in the intervening member, and a movable member that moves between a restricting position at which the movable member interferes with a passage range of the motion limiter and a non-restricting position at which the movable member is located away from the passage range of the motion limiter. With the rotational angle restricting mechanism constructed as described above, when the movable member moves from the non-restricting position to the restricting position, the movable member interferes with the passage range of the rotation limiter or the passage range of the motion limiter so that free rotation of the rotating member or free movement of the intervening member can be inhibited. In this manner, the transmission of rotary motion of the electric motor by the power transmitting mechanism is restricted in the motion transmission path, so that the rotational angle of the cam can be restricted.

In the valve drive system according to the first aspect of the invention, the internal combustion engine may have a plurality of cylinders each serving as the above-indicated cylinder, and a plurality of valves each serving as the above-indicated valve, which are disposed in the respective cylinders, and the power transmitting mechanism may have a plurality of cams each serving as the above-indicated cam and respectively corresponding to the valves, and may have the first electric motor provided for driving at least one of the cams and the second electric motor provided for driving the remainder of the cams, each of the first and second electric motors serving as the above-indicated electric motor. Furthermore, the rotational angle restricting mechanism may include a rotational angle restricting unit that is an integrated assembly of the first rotational angle restricting mechanism capable of restricting rotation of the above-indicated at least one cam driven by the first electric motor within the predetermined angular range, and the second rotational angle restricting mechanism capable of restricting rotation of the remainder of the cams driven by the second electric motor within the predetermined angular range. In this embodiment, rotation of the cams provided for two or more different cylinders can be restricted by a signal rotational angle restricting unit. This arrangement is advantageous in reduced installation space, as compared with the case where the rotational angle restricting mechanisms are provided for the respective cams.

In the valve drive system according to the first aspect of the invention, a plurality of rotational angle restricting mechanisms each serving as the above-indicated rotational angle restricting mechanism may be provided for restricting rotation of the cam within a plurality of predetermined angular ranges (each being equivalent to the above-indicated predetermined angular range) that are different from each other. In this embodiment, it is possible to vary the angular range to which the rotational angle of the cam is restricted, by selectively operating the two or more rotational angle restricting mechanisms. In this embodiment, the predetermined angular range of at least one of the rotational angle restricting mechanisms may be set so that the valve and a piston disposed in the engine do not interfere with each other. In this case, it is possible to prevent valve/piston interference without fail, by operating the rotational angle restricting mechanism in which the predetermined angular range is set to the range in which the piston and the valve do not interfere with each other.

The valve drive system according to the first aspect of the invention may further include motor control means for stopping supply of electric current to the electric motor when the current supplied to the electric current or a physical quantity corresponding to the current exceeds a predetermined value as driving torque of the electric motor increases. In general, the driving torque of the electric motor increases when rotation of the cam is restricted by the rotational angle restricting mechanism. With the above arrangement, supply of current to the electric motor is stopped when the driving torque of the electric motor exceeds the predetermined value, so that the electric motor can be stopped in association with restriction of rotation of the cam by the rotational angle restricting mechanism.

In the valve drive system according to the first aspect of the invention, the internal combustion engine may be installed on a vehicle to serve as a power source for driving, and motor control means may be further provided which is capable of executing a restricting oscillation mode for restricting a lift of the valve by oscillating the cam within an oscillation range less than one rotation, so that the vehicle is able to run under a limp-home mode in which the running speed of the vehicle is restricted when an abnormality occurs in the engine. Also, the above-indicated predetermined angular range may be set to an angular range that is larger than the oscillation range of the restricting oscillation mode. In this embodiment, since the predetermined angular range to which rotation of the cam is restricted by the rotational angle restricting mechanism is larger than the oscillation range of the restricting oscillation mode, the vehicle is able to perform limp-home running in the restricting oscillation mode while rotation of the cam is also restricted by the rotational angle restricting mechanism. This arrangement does not cause the vehicle to be unable to run due to insufficient power of the engine when the rotation of the cam is restricted by the rotational angle restricting mechanism, and is thus able to appropriately deal with the abnormality in the engine. In this embodiment, the internal combustion engine may have a plurality of cylinders each serving as the above-indicated cylinder, and a plurality of valves each serving as the above-indicated valve, which are disposed in the respective cylinders. When an abnormality occurs to one or more of the cylinders, the oscillation range of the restricting oscillation mode may be set so that the vehicle is able to run in the limp-home mode while halting only the above one or more of the cylinders. In this case, the vehicle is able to run in the limp-home mode while halting only part of the cylinders, namely, with a reduced number of cylinders operating.

In the valve drive system according to the first aspect of the invention, the internal combustion engine may be installed on a vehicle to serve as one of a plurality of power sources for driving, and the vehicle may be arranged to be able to run only with one or more of the power sources other than the engine. Furthermore, the rotational angle restricting mechanism may restrict rotation of the cam so as to stop the valve at a predetermined position. The vehicle of this embodiment is generally known as a hybrid vehicle, which is provided with an electrically operated power source, such as a motor generator, as a power source for driving other than the engine. In this embodiment, upon occurrence of some abnormality to the engine, the rotational angle restricting mechanism mechanically stops the valve at the predetermined position, thereby to stop the engine, and then the running power source is switched from the engine to the running power source other than the engine so that the vehicle can continue running. The predetermined position at which the valve is stopped may be determined as appropriate. For example, rotation of the cam may be restricted so that the valve is stopped at a position at which pumping loss can be reduced, or rotation of the cam may be restricted so that the valve is stopped at a position at which the valve is in a fully closed state or at a position at which a lift of the valve is equal to or larger than a predetermined amount.

The second aspect of the invention concerns a valve drive system which includes a power transmitting mechanism that converts rotary motion of an electric motor into opening and closing motion of a valve provided in a cylinder of an internal combustion engine to transmit power from the electric motor to the valve via a cam, and a rotational angle restricting mechanism that is provided in a motion transmission path that extends from the electric motor to the cam, and is capable of restricting rotation of the cam within a predetermined angular range that is set so that the valve and a piston disposed in the engine do not interfere with each other. The second aspect of the invention also concerns a method of driving the valves in the manner as described above.

In the valve drive system as described above, the rotational angle of the cam can be restricted by the rotational angle restricting mechanism. Under the restriction, the cam does not rotate beyond the predetermined angular range that is set so that the piston and the valve do not interfere with each other. In the case where the rotational angle of the cam needs to be restricted, for example, where rotation of the crankshaft and rotation of the cam are out of synchronism, the rotational angle restricting mechanism restricts the rotational angle of the cam, thereby to avoid interference between the piston and the valve. The construction of the rotational angle restricting mechanism is not limited to any particular construction. In one embodiment of the second aspect of the invention, the rotational angle restricting mechanism may include a rotation limiter provided in a rotating member disposed in the motion transmission path such that the rotation limiter is located at the radially outer side from a center of rotation of the rotating member, and a movable member that moves between a restricting position at which the movable member interferes with a passage range of the rotation limiter and a non-restricting position at which the movable member is located away from the passage range of the rotation limiter. In this embodiment, the movable member moves from the non-restricting position to the restricting position, so as to interfere with the passage range of the rotation limiter, thereby inhibiting free rotation of the rotating member. As a result, transmission of the rotary motion of the electric motor by the power transmitting mechanism is restricted in the motion transmission path, so that the rotational angle of the cam can be restricted.

The rotating member may be in any form provided that it is disposed in the motion transmission path. For example, where a transmitting mechanism, such as a gear train, is provided between the electric motor and a camshaft on which the cam is provided, a gear that constitutes the gear train may serve as the rotating member. Also, the rotating member may be in the form of a separate component provided on a gear shaft that rotates as a unit with the gear of the gear train. Furthermore, the power transmitting mechanism may have a camshaft on which the cam is provided, and the rotating member may be provided on the camshaft such that the rotating member can rotate as a unit with the camshaft. In this case, it is possible to restrict rotation of the camshaft by inhibiting free rotation of the rotating member. In this embodiment, the rotation limiter provided in the rotating member may be in the form of a groove portion that is formed on the rotating member so as to extend in a circumferential direction of the rotating member and has dimensions that allow insertion of the movable member thereinto. In this case, the rotation limiter can be easily realized through integral molding of the rotating member that is formed in advance with the groove portion, or by affecting a process to form the groove portion on the rotating member.

As a further example, the electric motor may have an output shaft while the power transmitting mechanism may have a camshaft on which the cam is provided, and the rotating member may be provided on the output shaft or the camshaft. In this case, the output shaft of the electric motor or the camshaft is used as the rotating member. This eliminates a need to prepare a rotating member as a separate component, and the number of components can be thus reduced.

The valve drive system according to the second aspect of the invention may further include restricting mechanism control means for controlling the rotational angle restricting mechanism so as to restrict rotation of the cam within the predetermined angular range when rotation of a crankshaft of the engine and rotation of the cam are out of synchronism. When rotation of the crankshaft and rotation of the cam go out of synchronism, there arises a possibility of interference between the piston and the valve. In this embodiment, the restricting mechanism control means operates to restrict rotation of the cam within the predetermined angular range when the rotations of the crankshaft and cam are out of synchronism, so that the otherwise possible interference between the piston and the valve can be avoided.

In the above-described embodiment, the valve drive system may further include motor control means for controlling the electric motor in a selected one of a plurality of modes including a restricting oscillation mode for oscillating the cam within the predetermined angular range, a normal oscillation mode for oscillating the cam beyond the predetermined angular range, and a normal rotation mode for rotating the cam in one direction. In this system, the motor control means may select and execute the restricting oscillation mode when rotation of the crankshaft of the engine and rotation of the cam are out of synchronism. In this case, when rotation of the crankshaft and rotation of the cam are out of synchronism, the electric motor is controlled by the motor control means so that the cam oscillates within the predetermined angular range while at the same time the rotational angle of the cam is restricted by the rotational angle restricting mechanism. Accordingly, even if a control error occurs to the motor control means, the cam is inhibited from rotating beyond the predetermined angular range due to the restriction imposed by the rotational angle restricting mechanism. Namely, the rotation of the cam is subjected to both the restriction according to the restricting oscillation mode and the restriction imposed by the rotational angle restricting mechanism. With the restriction thus doubled, the interference between the piston and the valve can be avoided without fail, thus assuring improved reliability.

In the valve drive system according to the first or second aspect of the invention, the internal combustion engine may have a plurality of cylinders each serving as the above-indicated cylinder, and a plurality of valves each serving as the above-indicated valve, which are disposed in the respective cylinders, and a plurality of cams each serving as the above-indicated cam may be provided for driving the respective valves. In this system, the power transmitting mechanism may be arranged to convert rotary motion of the electric motor into opening and closing motion of each of the valves to transmit power from the electric motor to the valves via the cams, and the rotational angle restricting mechanism may be arranged to be able to restrict rotation of the plurality of cams. In this embodiment, the number of rotational angle restricting mechanisms can be reduced as compared with the case where rotational angle restricting mechanisms are provided for the respective cams of which rotation is to be restricted, and the reduction in the number of mechanisms advantageously contributes to a reduction in the cost.

In the valve drive system according to the first or second aspect of the invention, the rotational angle restricting mechanism may further include a hydraulic mechanism that moves the movable member between the restricting position and the non-restricting position by utilizing hydraulic pressure produced in accordance with an operation of the engine. In this embodiment, hydraulic pressure produced by the engine is utilized, and, therefore, a power source, such as an electric power source, is not needed for driving the movable member. Thus, the movable member can be driven with high-energy efficiency. In this embodiment, the hydraulic mechanism may include biasing means for biasing the movable member toward the restricting position, and may be operable to supply the hydraulic pressure so as to move the movable member from the restricting position to the non-restricting position. To the contrary, the hydraulic mechanism may include biasing means for biasing the movable member toward the non-restricting position, and may be operable to supply the hydraulic pressure so as to move the movable member from the non-restricting position to the restricting position. With the former hydraulic mechanism, the movable member can be held in the restricting position irrespective of the presence or absence of hydraulic pressure, and, therefore, rotation of the cam can be restricted even in a condition where the hydraulic pressure is at a low level. The latter hydraulic mechanism is suitably employed in an internal combustion engine, such as that installed on a hybrid vehicle, which has a high rotational speed at the time of starting, or in an internal combustion engine that operates frequently in a high-speed, high-load region.

In the valve drive system according to the first or second aspect of the invention, the rotational angle restricting mechanism may further include an electromagnetic driving mechanism that moves the movable member between the restricting position and the non-restricting position by utilizing electromagnetic force. This embodiment is advantageous in that the movable member can be driven without fail irrespective of the operating conditions of the engine.

In the valve drive system according to the first or second aspect of the invention, the power transmitting mechanism may have a camshaft on which the cam is provided, and the rotational angle restricting mechanism may be arranged to move the movable member in a direction parallel with the axis of the camshaft. In this embodiment, since the movable member moves in parallel with the axis of the camshaft, a dimension of the rotational angle restricting mechanism as measured in a direction perpendicular to the axis of the camshaft can be prevented from being undesirably large. In the valve drive system according to the first or second aspect of the invention, the power transmitting mechanism may have a camshaft on which the cam is provided, and the rotational angle restricting mechanism may be arranged to move the movable member in a direction perpendicular to the axis of the camshaft. In this embodiment, since the movable member moves in a direction perpendicular to the axis of the camshaft, a dimension of the rotational angle restricting mechanism as measured in the direction parallel with the axis of the camshaft can be prevented from being undesirably large.

As explained above, in the valve drive system according to the first aspect of the invention, the rotational angle restricting mechanism, which is provided in the motion transmission path, is able to mechanically restrict rotation of the cam. Also, in the valve drive system according to the second aspect of the invention, rotation of the cam is restricted within the predetermined angular range that is set so that the piston of the engine and the valve do not interference with each other, so that the interference between the piston and the valve can be avoided.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF THE PREFERRED EMBODIMENTS

Figure 1:
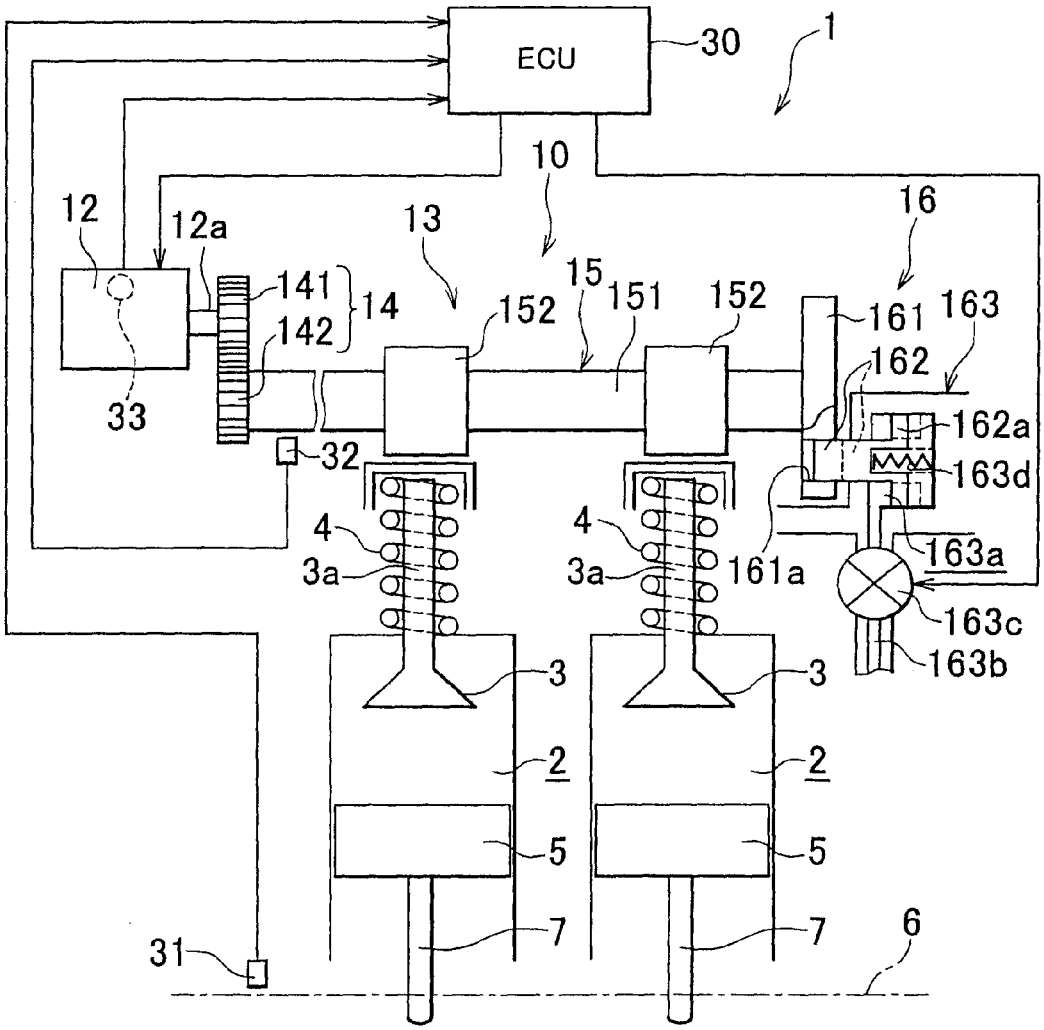
FIG. 1 is a view schematically showing a principal part of an internal combustion engine to which a valve drive system according to the first embodiment of the invention is applied.

FIG. 1 schematically shows a principal part of an internal combustion engine to which a valve drive system according to the first embodiment of the invention is applied. The internal combustion engine 1, which is installed on a vehicle to serve as a power source for driving, is an in-line four-cylinder engine in which four cylinders 2 are arranged in a single line. In FIG. 1, only the second cylinder 2 and a third cylinder 3, particularly the intake sides thereof, are illustrated for the sake of brevity, and first and fourth cylinders are not illustrated. Each of the cylinders 2 is provided with an intake valve 3 for opening and closing the cylinder 2, and an exhaust valve that is not illustrated. The intake valve 3 has a stem 3*a* that is passed through a stem guide of a cylinder head (not shown), and is thus capable of reciprocating in the direction of the axis of the stem 3*a*. The intake valve 3 is biased under reaction force of a valve spring 4 against compression thereof, in such a direction as to bring its valve face into close contact with a valve seat of an intake port. Each of the cylinders 2 is also provided with a piston 5 that is connected to a crankshaft 6 via a connecting rod 7, such that the piston 5 can reciprocate in the cylinder 2.

The engine 1 is provided with a variable valve actuating mechanism 10 that is in charge of opening and closing of the intake valves 3 as shown in FIG. 1. Another valve actuating mechanism that is similar in construction to the variable valve actuating mechanism 10 is provided for opening and closing intake valves of the first and fourth cylinders that are not illustrated. Also, the exhaust valves are opened and closed by mechanisms similar to the valve actuating mechanisms for the intake valves.

The variable valve actuating mechanism 10 has an electric motor 12, and a power transmitting mechanism 13 that converts rotary motion of the electric motor 12 into opening and closing motion of the intake valves 3 to transmit power from the motor 12 to the intake valves 3 via cams 152. The electric motor 12 may be in the form of, for example, a DC brushless motor capable of controlling its rotational speed. The electric motor 12 incorporates a position sensor 33, such as a resolver or a rotary encoder, for detecting its rotational position. The power transmitting mechanism 13 includes a gear train 14 and a cam mechanism 15. The gear train 14 has a motor gear 141 that rotates as a unit with an output shaft 12*a* of the electric motor 12, and a cam drive gear 142 that meshes with the motor gear 141. The cam mechanism 15 includes a camshaft 151 that is disposed coaxially with the cam drive gear 142 and can rotate as a unit with the cam drive gear 142. The camshaft 151 is provided with the above-mentioned cams 152 for opening and closing the intake valves 3 provided for the second cylinder 2 and the third cylinder 2, respectively, such that the cams 152 can rotate as a unit with the camshaft 151. Two cams 152 as shown in FIG. 1 are disposed on the camshaft 151 such that the tips or distal ends of noses of the cams 152 are spaced 180° apart from each other in the circumferential direction. With this arrangement, the valve-open period of the intake valve 3 of the second cylinder 2 does not overlap that of the intake valve 3 of the third cylinder 2. Cams for opening and closing intake valves of the first and fourth cylinders (not shown) are also arranged such that the valve-open periods of the intake valves of the first and fourth cylinders do not overlap each other.

Figure 2:
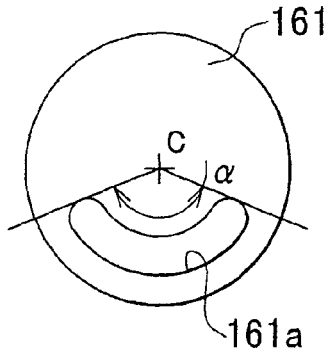
FIG. 2 is a front view of a flange of a rotational angle restricting mechanism as shown in FIG. 1.

The variable valve actuating mechanism 10 further includes a rotational angle restricting mechanism 16 for restricting the rotational angle of the cams 152. The rotational angle restricting mechanism 16 includes a disc-like flange 161 as a rotating member that is provided on the camshaft 151 to be able to rotate as a unit with the camshaft 151, a stopper pin 162 as a movable member that can be advanced into and retracted from the flange 161, and a hydraulic mechanism 163 provided as a driving means for driving the stopper pin 162. FIG. 2 is an enlarged view showing the flange 161 as viewed from the front. As shown in FIG. 2, the flange 161 is formed with a slotted groove hole 161*a* serving as a rotation limiter (groove portion) that is located at the radially outer side from the center C of rotation thereof. The groove hole 161*a* takes the form of a segment of a circle (or an arc) that extends in the circumferential direction of the flange 161, and has dimensions that allow insertion of the stopper pin 162 thereinto. As shown in FIG. 1, the stopper pin 162 moves between a restricting position as indicated by solid lines in FIG. 1 and a non-restricting position as indicated by broken lines in FIG. 1. When placed in the restricting position, the stopper pin 162 is inserted into the groove hole 161*a*, thereby to interfere with a passage range of the groove hole 161*a* (i.e., a range delimited by a portion of the flange 161 that defines the groove hole 161*a*). When placed in the non-restricting position, the stopper pin 162 is moved away from the passage range of the groove hole 161*a*.

To enable the above-described movements of the stopper pin 162, the hydraulic mechanism 163 includes a cylindrical oil pressure chamber 163*a* to which hydraulic pressure is supplied from an oil pump (not shown), a supply passage 163*b* that communicates with the oil pressure chamber 163*a*, and a solenoid-operated valve 163*c* that is disposed in the supply passage 163*b* and is switched between a position for allowing hydraulic pressure to be supplied to the oil pressure chamber 163*a* and a position for cutting off the hydraulic pressure. The stopper pin 162 has a flange-like piston portion 162*a* that slides in the oil pressure chamber 163*a*, and the stopper pin 162 is biased toward the restricting position under compression reaction force of a spring 163*d* provided in the oil pressure chamber 163*a*. With this arrangement, when the supply passage 163*b* is opened by the solenoid-operated valve 163*c*, the hydraulic pressure is supplied to the oil pressure chamber 163*a*. The hydraulic pressure then acts on the piston portion 162*a* of the stopper pin 162, so that the stopper pin 162 moves from the restricting position to the non-restricting portion against the reaction force of the spring 163*d*. When the supply passage 163*b* is closed by the solenoid-operated valve 163*c*, on the other hand, the hydraulic pressure is cut off, namely, the supply of the hydraulic pressure is inhibited, so that the stopper pin 162 moves from the non-restricting position to the restricting position under the compression reaction force of the spring 163*d*.

As shown in FIG. 2, a central angle $\alpha$ formed between lines that connect the circumferentially opposite ends of the groove hole 161*a* and the center C of rotation of the flange 161 is set to be equal to or larger than a range $\beta$ of the oscillation angle of the camshaft 151 established in a restricting oscillation mode which will be described later. The upper limit of the central angle $\alpha$ is suitably set to a limit within which the pistons 5 of the engine 1 do not interfere with the intake valves 3. Thus, the flange 161 is inhibited from rotating beyond the angle $\alpha$ when the rotational angle restricting mechanism 16 operates to insert the stopper pin 162 into the groove hole 161*a* and hold the pin 162 in the restricting position. Namely, rotation of the camshaft 151 is restricted within the angular range whose upper limit is equal to the angle $\alpha$.

As shown in FIG. 1, the operations of the electric motor 12 of the variable valve actuating mechanism 10 and the solenoid-operated valve 163*a* of the rotational angle restricting mechanism 16 are respectively controlled by an engine control unit (ECU) 30 provided for appropriately controlling the operating conditions of the engine 1. The ECU 30 is a computer unit including a microprocessor and its peripheral components, such as a main memory, needed for the operation of the microprocessor. The ECU 30 performs various control operations according to valve control programs stored in its ROM. To the ECU 30 are connected various sensors, including a crank angle sensor 31 that outputs a signal indicative of the angle of the crankshaft 6, and a cam angle sensor 32 that outputs a signal indicative of the angle of the camshaft 151. The ECU 30 also receives an output signal of the position sensor 33 incorporated in the electric motor 12.

Initially, basic control of the electric motor 12 will be explained. The ECU 30 selects one of drive modes of the electric motor 12 which is suitable for the operating conditions of the engine 1, according to predetermined control rules, and controls the operation of the electric motor 12 so as to drive (i.e., open and close) the intake valves 3 in a manner corresponding to the selected drive mode. Thus, the ECU 30 functions as a motor control means. The drive modes executed by the ECU 30 include a normal rotation mode for controlling the electric motor 12 so that the cams 152 continuously rotate in one rotation, and an oscillation mode for oscillating the cams 152 (or camshaft 151) while switching the direction of rotation of the cams 152 between the normal direction and the reverse direction within one rotation or the range of 360°. The normal rotation mode is similar to a drive mode of a conventional valve actuating mechanism that operates to open and close intake valves by utilizing the rotary power of the crankshaft. In the normal rotation mode, each of the intake valves 3 moves in accordance with the profile of the corresponding cam 152. In the oscillation mode in which the direction of rotation of the cams 152 is switched within one rotation, it is possible to freely adjust the amount of lift of the intake valves 3 by suitably setting the angular range (or range of the oscillation angle) over which the cams 152 oscillate in this mode.

In this embodiment, two oscillation modes having different ranges of the oscillation angle are prepared as the above-mentioned oscillation mode. One of the two oscillation modes is a restricting oscillation mode in which the cams 152 oscillate within the angular range whose upper limit is equal to the central angle $\alpha$ of the groove hole 161*a* as described above. Namely, in the restricting oscillation mode, the relationship between the oscillation-angle range $\beta$ and the central angle $\alpha$ is $\beta \leqq \alpha$. Since the upper limit of the central angle $\alpha$ is set to a limit within which the pistons 5 do not interfere with the intake valves 3, valve/piston interference between the intake valves 3 and the pistons 5 do not occur when the restricting oscillation mode is normally executed, even if rotation of the crankshaft 6 and rotation of the camshaft 151 are out of synchronism. The other of the above-indicated two oscillation modes is a normal oscillation mode in which the cams 152 oscillate beyond the angular range whose upper limit is equal to the central angle $\alpha$. In this mode, the relationship between the oscillation-angle range $\beta$ and the central angle $\alpha$ is $\beta > \alpha$. Accordingly, when rotation of the crankshaft 6 and rotation of the camshaft 151 are out of synchronism, valve/piston interference may take place. Thus, the normal oscillation mode is executed when the crankshaft 6 and the camshaft 151 are kept synchronized with each other.

Next, various controls performed by the ECU 30 will be explained assuming that the drive modes as described above are available.

To normally operate the engine 1, it is necessary to synchronize rotation of the crankshaft 6 and rotation of the camshaft 151. To achieve the synchronization, the ECU 30 controls the operation of the electric motor 12 with reference to the output signal of the crank angle sensor 31 provided for the crankshaft 6 and the output signal of the cam angle sensor 32 provided for the camshaft 151. In the event of a failure of the engine 1, namely, in the case where an abnormality occurs to the engine 1 for some reason, the synchronism between the crankshaft 6 and the camshaft 151 may be lost. If any countermeasure against the failure is performed or the engine 1 continues operating under the condition of loss of the synchronism, valve/piston interference may take place. Thus, the ECU 30 performs fail-safe control as described below for avoiding valve/piston interference at the time of a failure of the engine.

Figure 3:
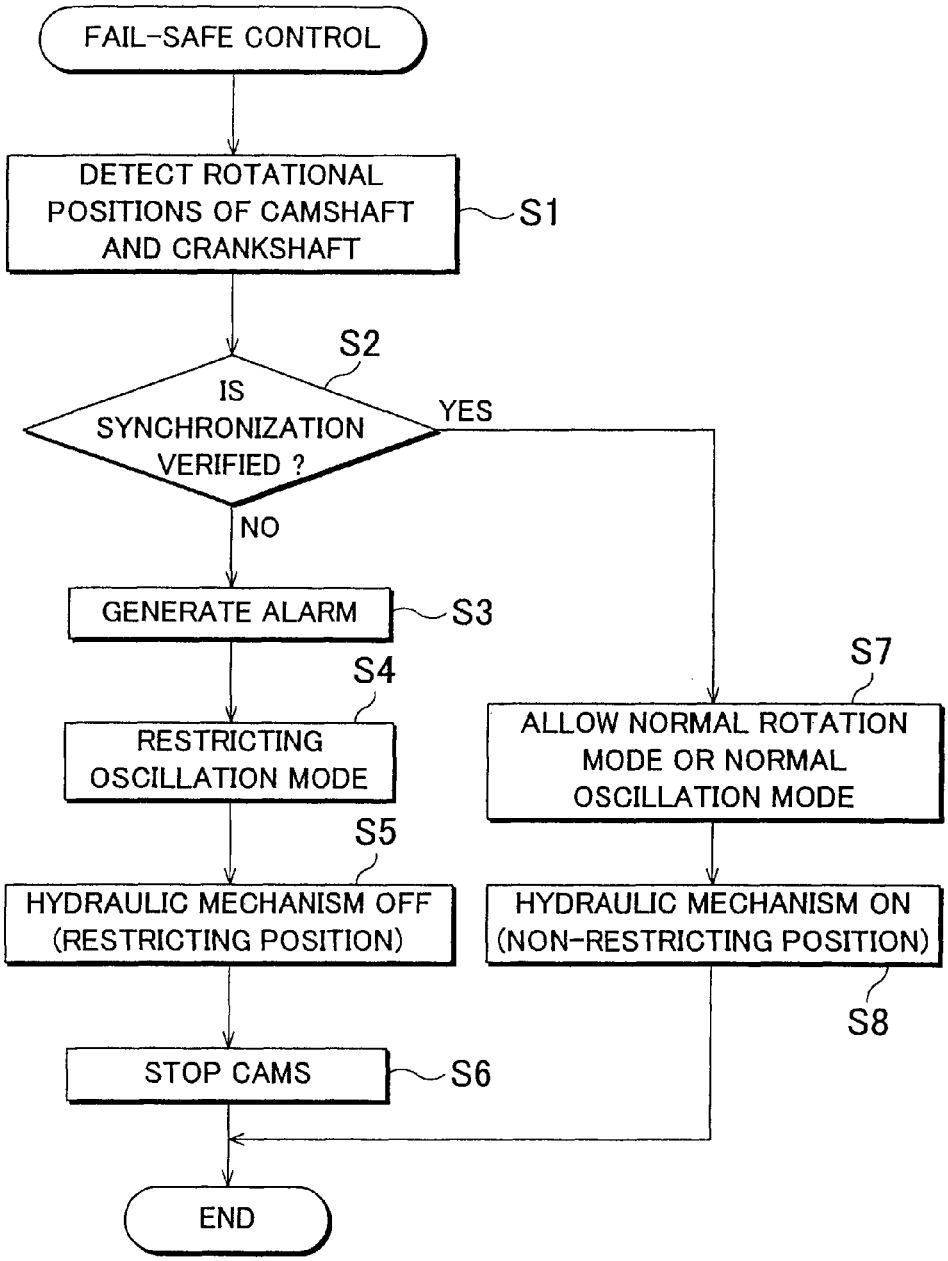
FIG. 3 is a flowchart illustrating an example of a control routine of fail-safe control.

FIG. 3 is a flowchart showing an example of a control routine of the fail-safe control. The routine of FIG. 3 is stored in advance in the ECU 30, and the ECU 30 retrieves and repeatedly executes this routine as needed. Initially, the ECU 30 detects the rotational position of the crankshaft 6 and the rotational position of the camshaft 151 in step S1, based on the output signals of the crank angle sensor 31 and cam angle sensor 32, respectively. The ECU 30 then checks in step S2 whether the crankshaft 6 and the camshaft 151 rotate in synchronization with each other, based on the detection results obtained in step S1. If the crankshaft 6 and the camshaft 151 do not rotate in synchronization with each other, namely, if they are out of synchronism, the ECU 30 goes to step S3. If the synchronization between the crankshaft 6 and the camshaft 151 is verified, the ECU 30 goes to step S7.

In step S3, warning information, such as an alarm, is generated so as to inform the driver that some abnormality has occurred to the engine 1. In the next step S4, the ECU 30 selects the restricting oscillation mode as the drive mode of the electric motor 12, and executes the restricting oscillation mode. In the following step S5, the hydraulic mechanism 163 of the rotational angle restricting mechanism 16 is placed in the OFF state. More specifically, the ECU 30 controls the solenoid-operated valve 163*c* so as to stop supply of hydraulic pressure to the oil pressure chamber 163*a* of the hydraulic mechanism 163, thereby to move the stopper pin 162 to the restricting position. Then, the ECU 30 controls the electric motor 12 so as to stop the operation of the cams 152, and then finishes the current cycle of the routine.

In step S7, on the other hand, the electric motor 12 is allowed to operate in the normal rotation mode or normal oscillation mode since the synchronization between the crankshaft 6 and the camshaft 151 has been verified. In the following step S8, the hydraulic mechanism 163 is placed in the ON state. More specifically, the ECU 30 controls the solenoid-operated valve 163*c* so as to supply hydraulic pressure to the oil pressure chamber 163*a* of the hydraulic mechanism 163, thereby to move the stopper pin 162 to the non-restricting position. Then, the ECU 30 finishes the current cycle of the routine.

Through execution of the control routine of FIG. 3, the oscillation angle of the camshaft 151 is restricted under the restricting oscillation mode when the crankshaft 6 and camshaft 151 go out of synchronism because of a failure, and, furthermore, the stopper pin 162 is placed in the restricting position by the rotational angle restricting mechanism 16. With this arrangement, even in the event that the oscillation angle of the cams 152 become unexpectedly large due to an error that occurs in control under the restricting oscillation mode, the rotational angle of the cams 152 is physically restricted by the rotational angle restricting mechanism 16 so that the pistons 5 and the intake valves 3 do not interfere with each other. Thus, valve/piston interference can be avoided without fail, assuring improved reliability.

Figure 4:
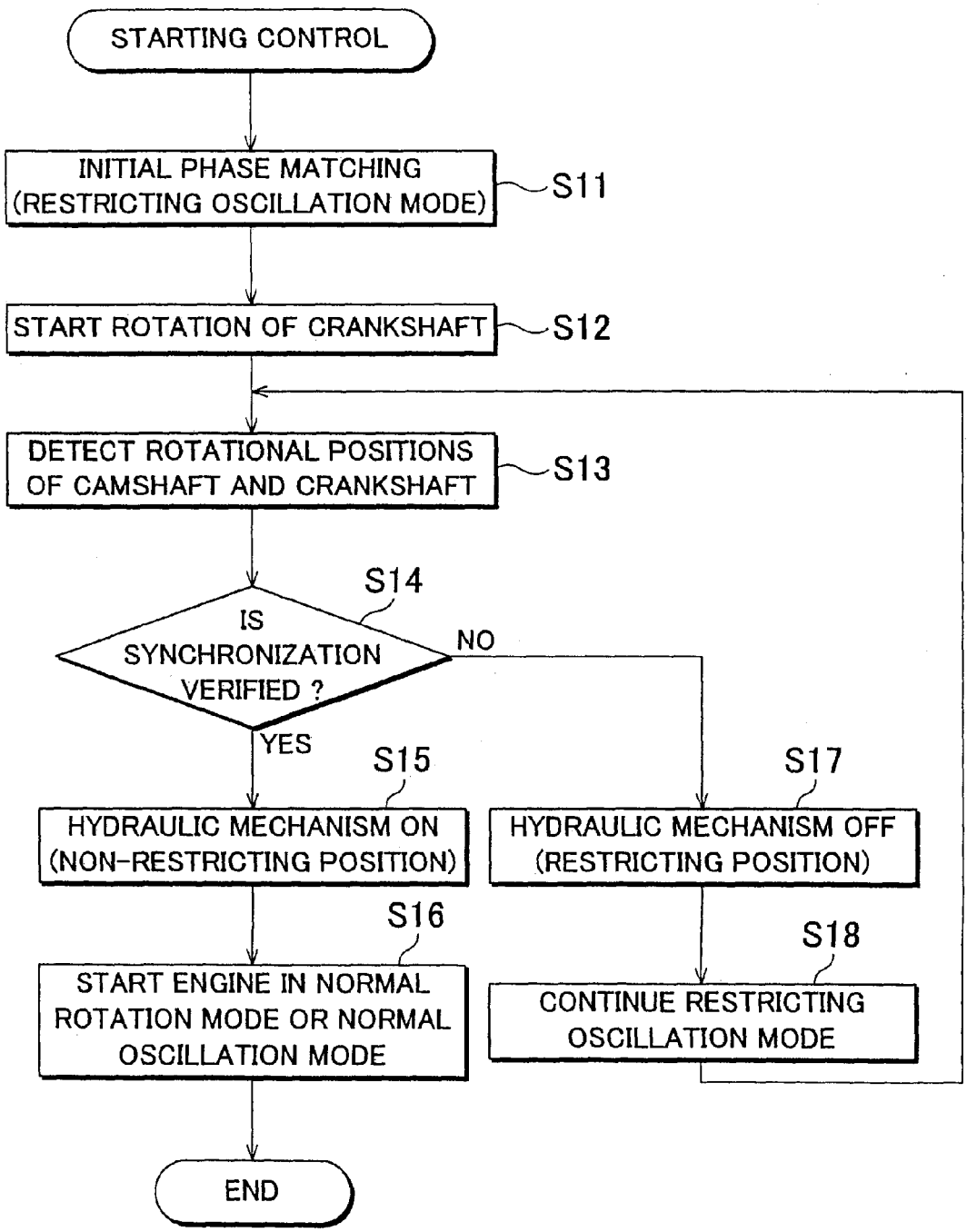
FIG. 4 is a flowchart illustrating an example of a control routine of starting control.

If the engine 1 is started in the normal rotation mode or normal oscillation mode while the synchronization between the crankshaft 6 and the camshaft 151 has not been verified, any of the pistons 5 may be stopped at around the top dead center. In this case, valve/piston interference may take place. To prevent the valve/piston interference at the time of starting of the engine 1, starting control of FIG. 4 is performed. FIG. 4 is a flowchart showing an example of a control routine of the starting control. The ECU 30, which stores a program of the routine of FIG. 4 in advance, retrieves and executes the program as needed. Initially, the ECU 30 performs the initial phase matching in step S11 so as to establish an appropriate relationship between the positions or phases of the electric motor 12 and the camshaft 151. The initial phase matching is performed while the crankshaft 6 is being stopped, with reference to the output signals of the cam angle sensor 32 and the position sensor 33 incorporated in the electric motor 12. At this time, the electric motor 12 is driven in the restricting oscillation mode so as to prevent interference between the piston 5 stopped at around the top dead center and the corresponding intake valve 3.

In the next step S12, a starter motor (not shown) is driven to start rotating the crankshaft 6. In the following step S13, the rotational position of the crankshaft 6 and the rotational position of the camshaft 151 are detected based on the output signals of the crank angle sensor 31 and cam angle sensor 33, respectively. Then, the ECU 30 checks in step S14 whether the crankshaft 6 and the camshaft 151 rotate in synchronization with each other, based on the detection results obtained in step S13. If the synchronization between the crankshaft 6 and the camshaft 151 is verified, the ECU 30 goes to step S15. If the crankshaft 6 and the camshaft 151 are out of synchronism, the ECU 30 goes to step S17.

In step S15, the hydraulic mechanism 163 is placed in the ON state. More specifically, the ECU 30 controls the solenoid-operated valve 163*c* so as to supply hydraulic pressure to the oil pressure chamber 163*a* of the hydraulic mechanism 163, thereby to move the stopper pin 162 to the non-restricting position. Step S16 is then executed to switch the drive mode of the electric motor 12 from the restricting oscillation mode to the normal rotation mode or normal oscillation mode and start the engine 1. Then, the current cycle of the routine is finished. In step S17, on the other hand, the hydraulic mechanism 163 is placed in the OFF state. More specifically, the ECU 30 controls the solenoid-operated valve 163*c* so as to stop supply of hydraulic pressure to the oil pressure chamber 163*a* of the hydraulic mechanism 163, thereby to move the stopper pin 162 to the restricting position. In the next step S18, the ECU 30 continues operating the electric motor 12 in the restricting oscillation mode, and then returns to step S13.

Through execution of the control routine of FIG. 4, the oscillation angle of the camshaft 151 is restricted under the restricting oscillation mode while the synchronization between the crankshaft 6 and the camshaft 151 is not verified, and, furthermore, the stopper pin 162 is held in the restricting position by the rotational angle restricting mechanism 16. Thus, valve/piston interference can be avoided without fail at the time of starting of the engine 1.

Figure 5:
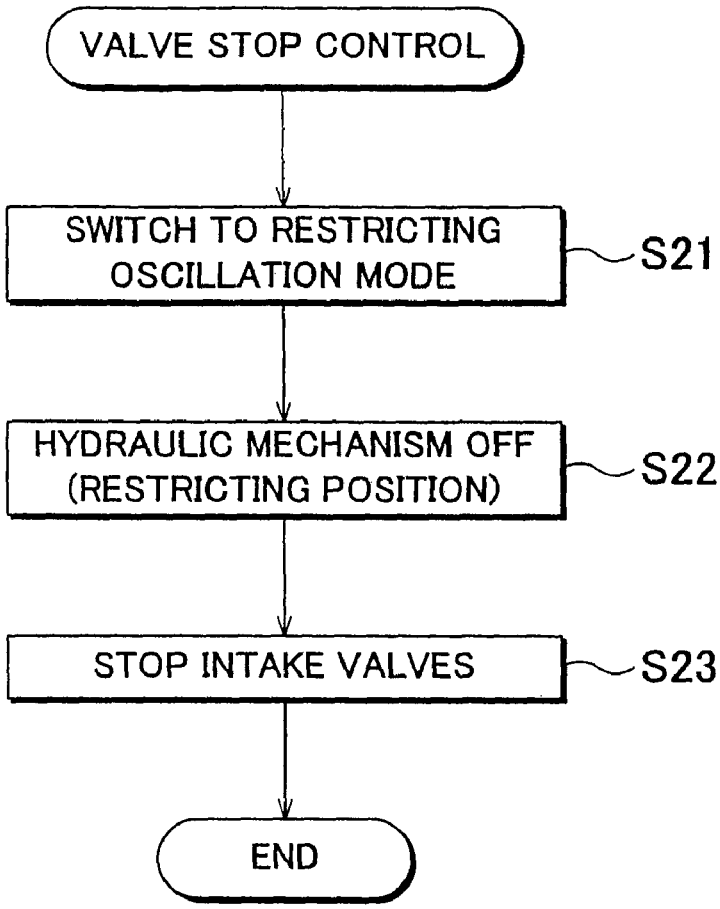
FIG. 5 is a flowchart illustrating an example of a control routine of valve stop control.

The ECU 30 performs a so-called cylinder cutoff operation for the purpose of, for example, enhancing the fuel economy of the engine 1. While specific explanation concerning the cylinder cutoff operation is not provided herein, the ECU 30 performs valve stop control of FIG. 5 so as to prevent valve/piston interference in the cylinders in which the intake valves 3 are stopped. The ECU 30, which stores a program of the routine of FIG. 5 in advance, retrieves and executes the program as needed. Initially, the ECU 30 switches the drive mode to the restricting oscillation mode in step S21. In the next step S22, the hydraulic mechanism 163 is placed in the OFF state. More specifically, the ECU 30 controls the solenoid-operated valve 163*c* so as to stop supply of hydraulic pressure to the oil pressure chamber 163*a* of the hydraulic mechanism 163, thereby to move the stopper pin 162 to the restricting position. In step S23, the ECU 30 stops energization of the electric motor 12 so as to stop opening and closing movements of the intake valves 3. Then, the current cycle of the routine is finished.

After the ECU 30 stops energization of the electric motor 12 in step S23, the camshaft 151 keeps rotating through inertia until the intake valves 3 are completely stopped, resulting in loss of synchronism between the crankshaft 6 and the camshaft 151. Nonetheless, valve/piston interference can be avoided since the drive mode has been switched to the restricting oscillation mode in step S21. Furthermore, since the stopper pin 162 is held in the restricting position by the rotational angle restricting mechanism 16 after the drive mode is switched to the restricting oscillation mode, valve/piston interference can be avoided without fail even in the case where a control error occurs when the intake valves 3 are stopped.

To resume the operation of the cylinders in which the valves are stopped, a control process similar to that of the starting control as shown in FIG. 4 may be carried out. More specifically, the operation may be resumed by executing a routine that is identical with that of FIG. 4 except that step S12 is eliminated.

In the first embodiment, a combination of the variable valve actuating mechanism 10 and the ECU 30 may be regarded as a valve drive system of the invention. Also, the ECU 30, which executes step S5 and step S8 of FIG. 3, step S15 and step S17 of FIG. 4, step S22 of FIG. 5 and step S5 and step S8 of FIG. 11, functions as a restricting mechanism control means.

Figure 6:
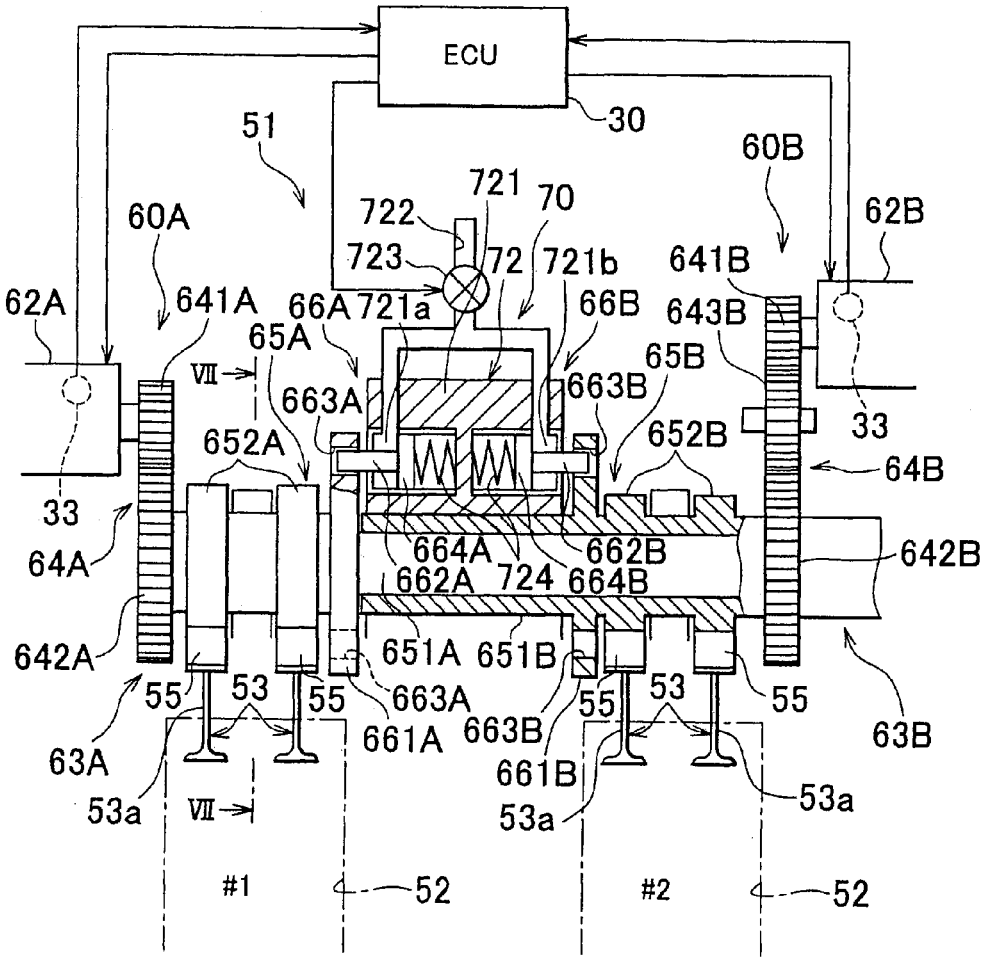
FIG. 6 is a view schematically showing a principal part of an internal combustion engine to which a valve drive system according to the second embodiment of the invention is applied.
Figure 7:
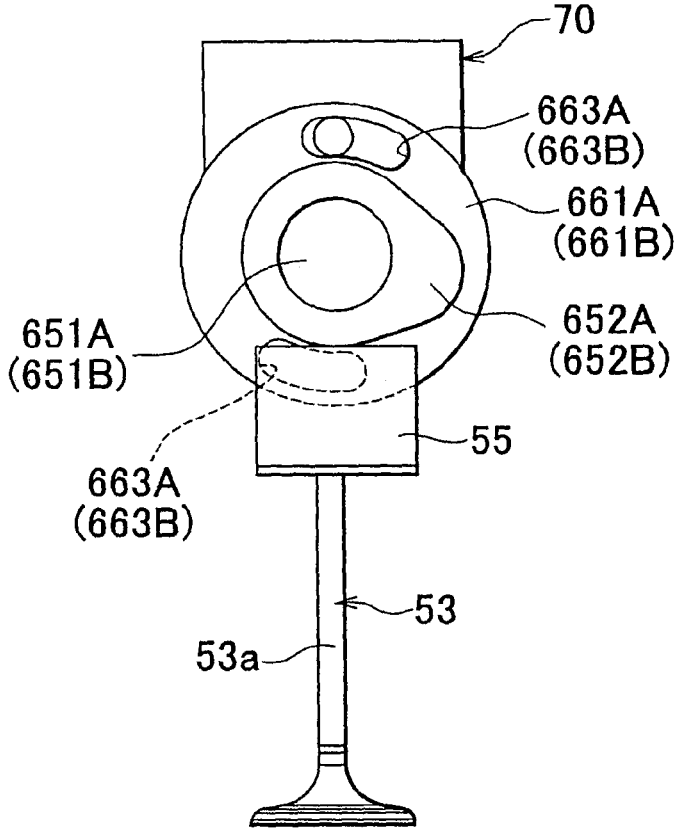
FIG. 7 is an enlarged view of the engine of FIG. 6 as viewed in a direction of arrows VII-VII in FIG. 6.

Next, the second embodiment of the invention will be explained. FIG. 6 schematically shows a principal part of an internal combustion engine to which a valve drive system according to the second embodiment is applied. FIG. 7 is an enlarged view of the engine of FIG. 6 as viewed in the direction of arrows VII-VII in FIG. 6. As shown in FIG. 6 and FIG. 7, the internal combustion engine 51, which is installed on a vehicle to serve as a power source for driving, is an in-line four-cylinder engine, like the engine 1 of FIG. 1. The engine 51 includes four cylinders 52 (only two of which are illustrated in FIG. 6), and each of the cylinders 52 is provided with two intake valves 53 and two exhaust valves (not shown). Each of the intake valves 53 has a stem 53*a* that is passed through a stem guide of a cylinder head (not shown), and is thus capable of reciprocating in the direction of the axis of the stem 53*a*. The intake valve 53 is biased under reaction force of a valve spring (not shown) against compression thereof, in such a direction as to bring its valve face into close contact with a valve seat of an intake port. Although not illustrated in detail, each of the cylinders 52 is provided with a piston that is connected to a crankshaft via a connecting rod, such that the piston can reciprocate in the cylinder 52, as in the embodiment of FIG. 1.

The engine 51 is provided with first variable valve actuating mechanism 60A and second variable valve actuating mechanism 60B for opening and closing the intake valves 53. The first variable valve actuating mechanism 60A is in charge of opening and closing the intake valves 53 of the outside two cylinders, namely, the first and fourth cylinders 52, and the second variable valve actuating mechanism 60B is in charge of opening and closing the intake valves 53 of the inside two cylinders, namely, the second and third cylinders 52. In FIG. 6, the third and fourth cylinders 52 and other components and mechanisms associated with these cylinders are not illustrated. The first variable valve actuating mechanism 60A has an electric motor 62A, and a power transmitting mechanism 63A that converts rotary motion of the electric motor 62A into opening and closing motion of the intake valves 53 to transmit power from the motor 62A to the intake valves 53 via cams 652A (which will be described later). Similarly, the second variable valve actuating mechanism 60B has an electric motor 62B, and a power transmitting mechanism 63B that converts rotary motion of the electric motor 62B into opening and closing motion of the intake valves 53 to transmit power from the motor 62B to the valves 53 via cams 652B (which will be described later). A valve lifter 55 as an intervening member is interposed between each of the cams 652A, 652B and a corresponding one of the intake valves 53.

The first electric motor 62A and second electric motor 62B are identical in construction with each other, and may be in the form of, for example, a DC brushless motor capable of controlling its rotational speed. As in the first embodiment, each of the electric motors 62A, 62B incorporates a position sensor 33, such as a resolver or a rotary encoder, for detecting its rotational position.

The power transmitting mechanism 63A includes a gear train 64A and a cam mechanism 65A. The gear train 64A has a motor gear 641A that rotates as a unit with the output shaft of the electric motor 62A, and a cam drive gear 642A that meshes with the motor gear 641A. The cam mechanism 65A includes a camshaft 651A that is disposed coaxially with the cam drive gear 642A and can rotate as a unit with the cam drive gear 642A. The camshaft 651A is provided with the above-mentioned cams 652A for opening and closing the intake valves 53 of the first and fourth cylinders 52, such that the cams 652A can rotate as a unit with the camshaft 651A.

On the other hand, the power transmitting mechanism 63B, which is similar to the power transmitting mechanism 63A, includes a gear train 64B and a cam mechanism 65B. The gear train 64B has the same construction as the gear train 64A of the power transmitting mechanism 63A except that an intermediate gear 643B is interposed between a motor gear 641B and a cam drive gear 642B. The cam mechanism 65B includes a camshaft 651B in the form of a hollow shaft, which is disposed coaxially with the cam drive gear 642B and can rotate as a unit with the cam drive gear 642B. The camshaft 651B is assembled coaxially with the camshaft 651A of the power transmitting mechanism 63A such that the camshaft 651B surrounds the periphery of the camshaft 651A. The camshaft 651B is provided with the above-mentioned cams 652B for opening and closing the intake valves 53 of the second and third cylinders 52, such that the cams 652B can rotate as a unit with the camshaft 651B.

The engine 51 is provided with a rotational angle restricting unit 70 as a means for restricting the rotational angle of each of the cams 652A and cams 652B. The rotational angle restricting unit 70 is an integrated assembly of the first rotational angle restricting mechanism 66A for restricting rotation of the cams 652A and the second rotational angle restricting mechanism 66B for restricting rotation of the cams 652B. The first rotational angle restricting mechanism 66A includes a disc-like flange 661A as a rotating member that is provided on the camshaft 651A to be rotatable as a unit with the camshaft 651A, and a stopper pin 662A as a movable member that can be advanced into and retracted from the flange 661A. Similarly, the second rotational angle restricting mechanism 66B includes a flange 661B as a rotating member that is provided on the camshaft 651B to be rotatable as a unit with the camshaft 651B, and a stopper pin 662B as a movable member that can be advanced into and retracted from the flange 661B.

As shown in FIG. 7, the flange 661A is formed with two slotted groove holes 663A serving as rotation limiters (groove portions), which are spaced 180° apart from each other in the circumferential direction. Each of the groove holes 663A takes the form of a segment of a circle (or an arc) that extends in the circumferential direction of the flange 661A, and has dimensions that allow insertion of the stopper pin 662A thereinto. The flange 661B is also formed with two slotted groove holes 663B similar to the holes 663A of the flange 661A, and each of the groove holes 663B has dimensions that allow insertion of the stopper pin 662B thereinto.

Figure 8:
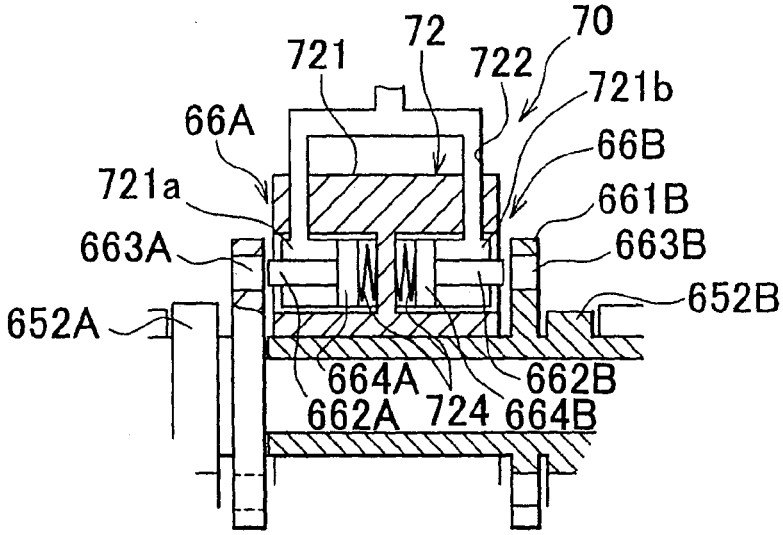
FIG. 8 is a view showing a condition in which stopper pins are placed in the non-restricting positions in the embodiment of FIG. 6.

The rotational angle restricting unit 70 further includes a hydraulic mechanism 72 that is hydraulically operated to drive the stopper pins 662A, 662B between the restricting positions as shown in FIG. 6 and the non-restricting positions as shown in FIG. 8. When placed in the restricting positions, the stopper pin 662A is inserted into one of the groove holes 663A, and the stopper pin 662B is inserted into one of the groove holes 663B, so that the stopper pin 662A interferes with the passage range of the groove hole 663A, and the stopper pin 662B interferes with the passage range of the groove hole 663B. When placed in the non-restricting positions, on the other hand, the stopper pin 662A is moved away from the passage range of the groove hole 663A, and the stopper pin 662B is moved away from the passage range of the groove hole 663B. As a result, restriction on the rotation of each of the cams 662A, 662B is cancelled or removed.

The hydraulic mechanism 72 is supplied with hydraulic pressure produced by an oil pump (not shown) that is driven by the engine 51, namely, hydraulic pressure produced in accordance with the operation of the engine 51. The hydraulic mechanism 72 includes a housing 721 in which an oil pressure chamber 721*a* that contains the stopper pin 662A and an oil pressure chamber 721*b* that contains the stopper pin 662B are formed, a supply passage 722 that communicates with the oil pressure chambers 721*a*, 721*b*, and a solenoid-operated valve 723 that is disposed in the supply passage 722 and is switched between a position for allowing hydraulic pressure to be supplied to the oil pressure chambers 721*a*, 721*b* and a position for cutting off the hydraulic pressure. The stopper pin 662A has a flange-like piston portion 664A that can slide in the oil pressure chamber 721*a*, and is biased toward the restricting position under compression reaction force of a spring 724 provided as biasing means in the oil pressure chamber 721*a*. Similarly, the stopper pin 662B has a flange-like piston portion 664B that can slide in the oil pressure chamber 721*b*, and is biased toward the restricting position under compression reaction force of a spring 724 provided as biasing means in the oil pressure chamber 721*b*. With this arrangement, when the supply passage 722 is opened by the solenoid-operated valve 723, hydraulic pressures are supplied to the respective oil pressure chambers 721*a*, 721*b*. These hydraulic pressures act on the piston portion 664A of the stopper pin 662A and the piston portion 664B of the stopper pin 662B, respectively, so as to move the stopper pins 662A, 662B from the restricting positions to the non-restricting positions against the reaction force of the springs 724. When the supply passage 722 is closed by the solenoid-operated valve 723, on the other hand, the supply of the hydraulic pressure is inhibited or the hydraulic pressure is cut off, so that the stopper pins 662A, 662B move from the non-restricting positions to the restricting positions under the compression reaction force of the springs 724.

Figure 9:
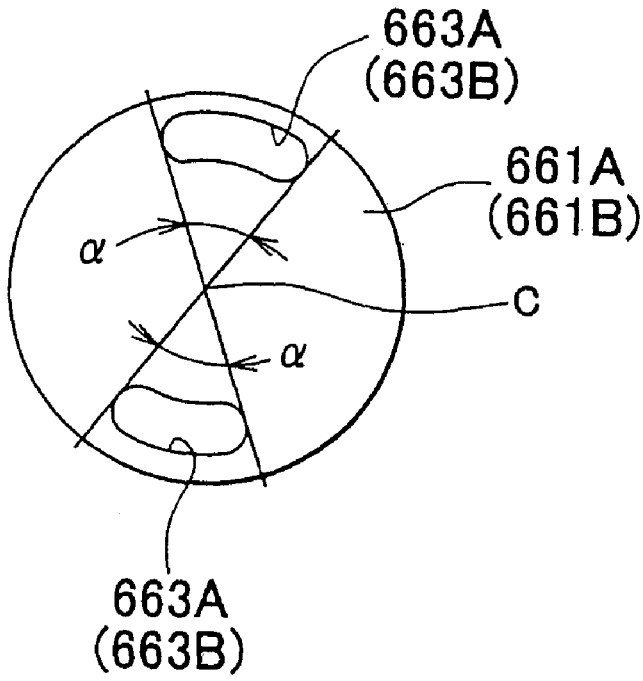
FIG. 9 is a front view of a flange of the second embodiment.

FIG. 9 is a front view of the flange 661A. FIG. 9 is also used for explaining the flange 661B having the same construction as the flange 661A. As shown in FIG. 9, the central angle $\alpha$ formed between lines that pass the circumferentially opposite ends of each of the groove holes 663A, 663B and the center C of rotation of the flange 661A, 661B is set in the same manner as that of the flange 161 (FIG. 2) of the first embodiment. Namely, the upper limit of the central angle $\alpha$ is suitably set to a limit within which the pistons (now shown) of the engine 51 do not interfere with the intake valves 53. With this arrangement, when the stopper pin 662 and stopper pin 662B are inserted into one of the groove holes 663A and one of the groove holes 663B, respectively, to be held in the restricting positions, the rotation of each of the camshafts 651A, 651B is restricted within the angular range whose upper limit is equal to the angle $\alpha$. In other words, the rotation of each of the cams 652A, 652B is restricted within the angular range whose upper limit is equal to the angle $\alpha$. Thus, when each of the stopper pins 662A, 662B is held in the restricting position, valve/piston interference between the pistons and the intake valves 53 can be prevented. Also, since each pair of the groove holes 663A, 663B are formed in one flange such that the two groove holes 663A, 663B are spaced 180° from each other in the circumferential direction, the rotation of the cams can be restricted irrespective of the orientation of the cams on the camshaft when the cams oscillate within one rotation in the oscillation mode.

The ECU 30 as shown in FIG. 6 is able to control each of the electric motors 62A, 62B and the hydraulic mechanism 72 of the rotational angle restricting unit 70 of the second embodiment, by methods similar to the methods as explained above with respect to the first embodiment. Thus, the ECU 30 as shown in FIG. 6 functions as motor control means and restricting mechanism control means of the invention. Although not illustrated in FIG. 6, the ECU 30 receives signals of a crank angle sensor and cam angle sensors, in the same manner as in the first embodiment.

It is to be understood that the invention is not limited to the illustrated embodiments, but may be embodied in various forms within the range of the principle of the invention. In each of the illustrated embodiments, the upper limit of the central angle α (FIG. 2 and FIG. 9) of the groove hole serving as a rotation limiter is set within a range in which the pistons and the intake valves do not interfere with each other, so that the rotation of the cams is restricted within the angular range in which the piston/valve interference does not occur. However, the angular range of rotation of the cams may be set from a point of view that is different from the occurrence of the piston/valve interference, provided that the angular range is narrower than a range in which the cams rotate to such an extent as to provide the maximum lift of the intake valves.

Figure 10:
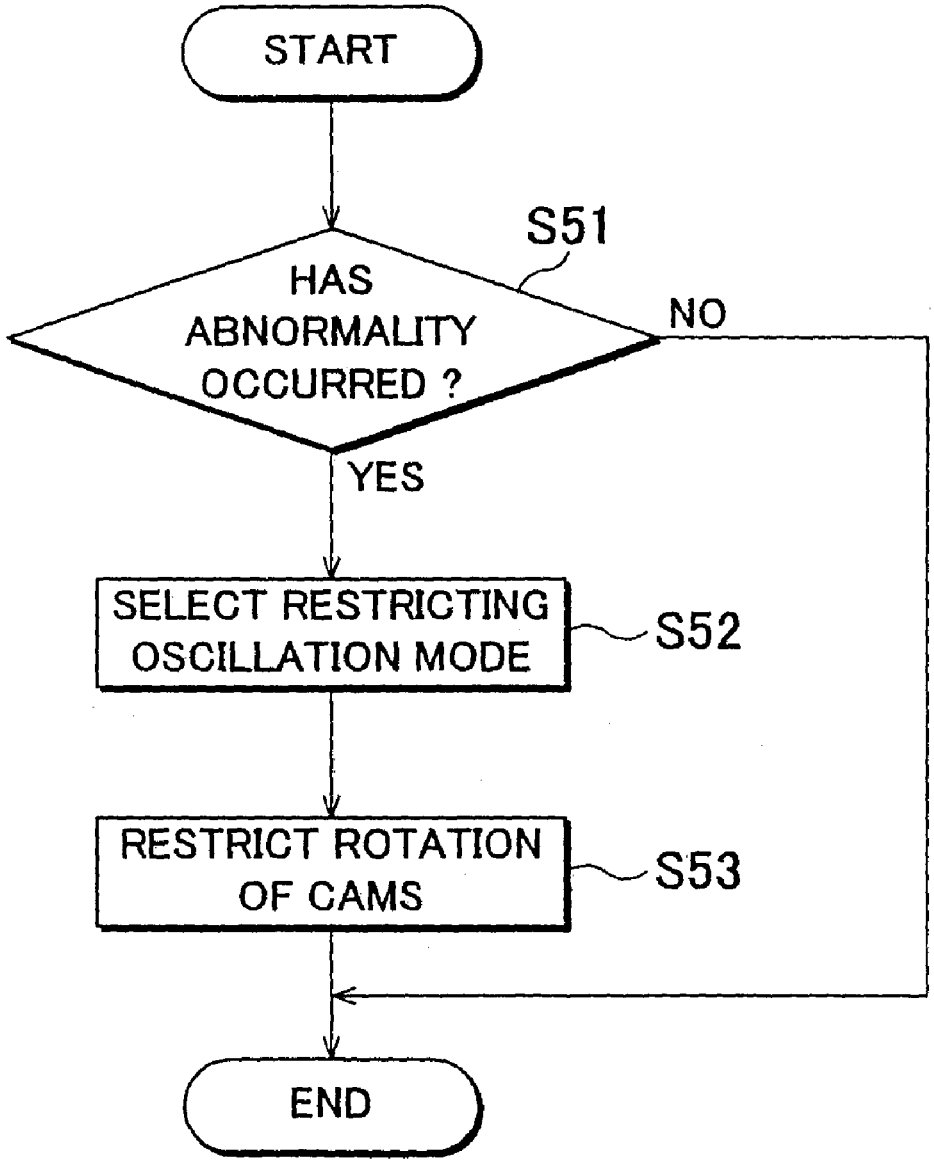
FIG. 10 is a flowchart illustrating an example of a control routine executed by an ECU when the vehicle runs under a limp-home mode.

For example, in the case where the vehicle on which the engine is installed as a power source for driving is able to run in a limp-home mode in which the running speed is restricted when an abnormality occurs to the engine, the rotation of the cams may be restricted so as not to impede limp-home running of the vehicle. More specifically, the oscillation range in which the cams oscillate in the above-mentioned restricting oscillation mode may be set to a range in which the vehicle is able to perform limp-home running, and the central angle α of the groove hole may be set to be larger than the oscillation range. FIG. 10 shows an example of a control routine to be executed by the ECU 30 when the vehicle runs under the limp-home mode. As shown in FIG. 10, the ECU 30 determines in step S51 whether an abnormality has occurred to the engine. If an abnormality has occurred, the ECU 30 goes to step S52. If not, the ECU 30 skips the following steps and finishes the current cycle of the routine. In step S52, the ECU 30 selects, as the drive mode of the electric motor, the restricting oscillation mode in which the oscillation range is set to a range in which the vehicle is able to perform limp-home running, and controls the electric motor so as to execute the restricting oscillation mode. In the following step S53, the rotating angle restricting mechanism is operated so as to restrict rotation of the cams. Then, the current cycle of the routine is finished. According to the control of FIG. 10, the cams oscillate within the restricted range of the rotational angle restricting mechanism, so that the vehicle can continue limp-home running. In the case where an abnormality occurs to one or more of the cylinders of the engine, and the vehicle is able to run in the limp-home mode while halting only the disabled cylinder or cylinders, the range within which the rotation of the cams is restricted by the rotational angle restricting mechanism may be determined so that the restriction of the rotational angle of the cams does not prevent the vehicle from running in the limp-home mode with the reduced number of cylinders operating. More specifically, the oscillation range of the cams in the restricting oscillation mode may be set to a range within which the vehicle is able to run in the limp-home mode with the reduced number of cylinders operating, and the central angle α of the groove hole may be set to be larger than the oscillation range.

Figure 11:
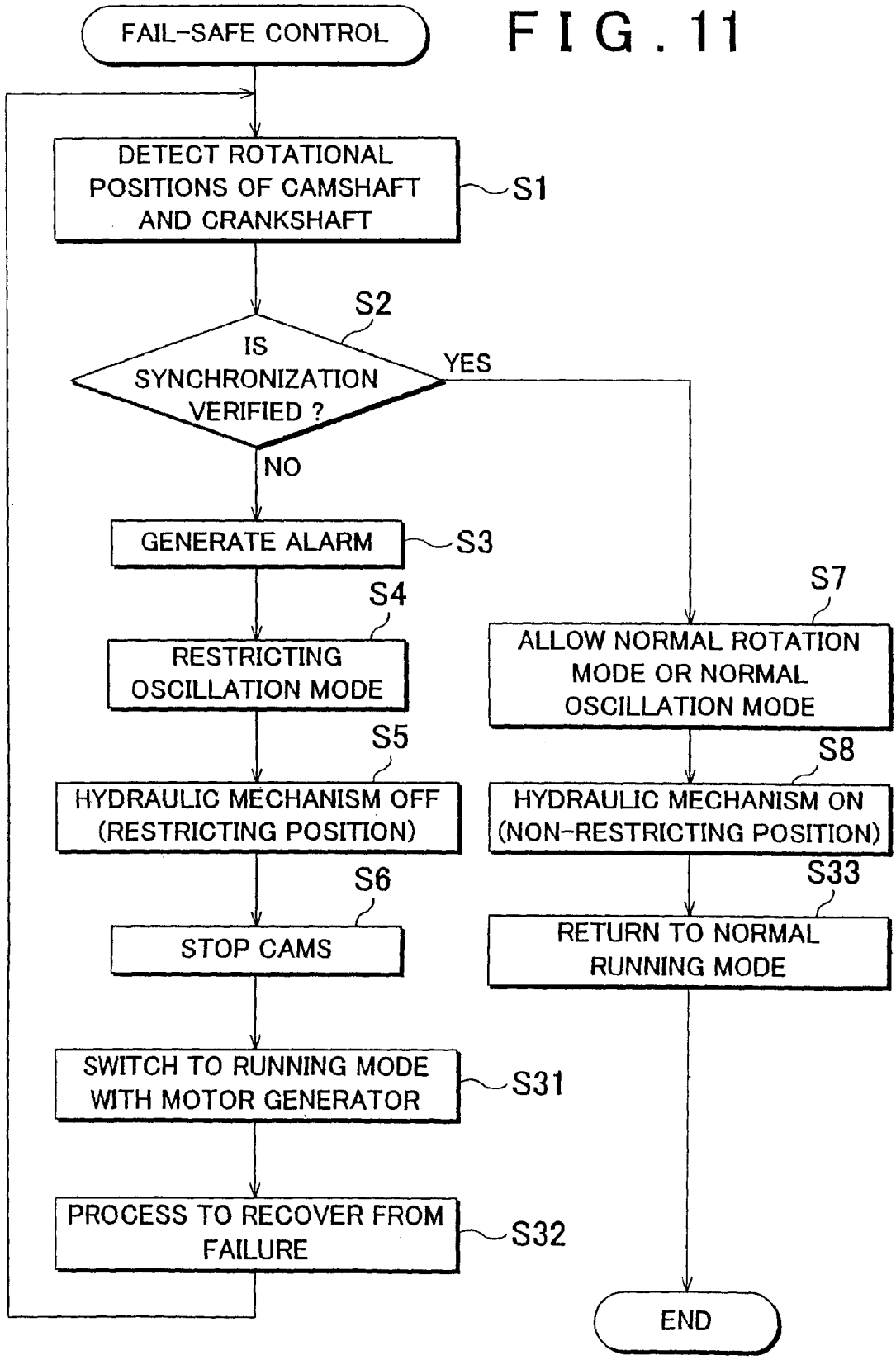
FIG. 11 is a flowchart illustrating an example of a control routine of fail-safe control to be performed with respect to a hybrid vehicle.

While the internal combustion engine 1 is provided as a power source for driving in the first embodiment, the invention may also be applied to a so-called hybrid vehicle including a motor generator as another power source for driving, in addition to the engine 1. While detailed explanation of the hybrid vehicle is not provided in this specification, the content of the fail-safe control as shown in FIG. 3 may be modified as described below in the case where the invention is applied to the hybrid vehicle. FIG. 11 is a flowchart illustrating an example of a control routine of fail-safe control to be performed with respect to a hybrid vehicle. In FIG. 11, the same reference numerals (step numbers) as used in FIG. 3 are used for identifying the same steps as those of FIG. 3, and repeated explanation of these steps will not be provided.

As shown in FIG. 11, after the cams are stopped in step S6, the ECU 30 stops using the engine 1 as a power source for driving in step S31, and switches the vehicle to a running mode in which only the motor generator is used as a power source for driving. In this manner, the vehicle is able to keep running even when an abnormality occurs to the engine 1. In the following step S32, the ECU 30 carries out a process to recover from a failure, a typical example of which is resetting of a program, and then returns to step S1. If the synchronization between the camshaft and the crankshaft is established as a result of the recovery process of step S32, step S7 and step S8 are executed, and step S33 is then executed to return the running mode to the normal running mode in which the engine 1 and the motor generator are selectively used according to predetermined control rules. When the engine 1 is re-started, the control of FIG. 4 may be used. At this time, the motor generator functions as a starter motor. According to the control of FIG. 11, the process to recover from a failure of the engine can be effected while the vehicle keeps running, and valve/piston interference can be avoided without fail during continued running of the vehicle.

When the invention is applied to a hybrid vehicle, the rotational angle restricting mechanism may restrict the rotation of the cams so that the intake valves are stopped at predetermined positions. Namely, the angular range to which the rotational angle restricting mechanism restricts the rotation of the cams may be set to zero. In other words, the cams may be locked by the rotational angle restricting mechanism. In this manner, when some abnormality occurs to the engine, the rotational angle restricting mechanism can mechanically stop the intake valves at the predetermined positions so as to stop the engine, and then the power source for driving is switched from the engine to the motor generator so that the vehicle can keep running. The positions at which the intake valves are stopped may be determined as appropriate. For example, the rotation of the cams may be restricted so that the valves are stopped at positions at which pumping loss can be reduced, or the rotation of the cams may be restricted so that the intake valves are placed in the fully closed state or at positions where the lifts are equal to or larger than a predetermined value.

The construction of the rotational angle restricting mechanism is not limited to those of the illustrated embodiments. In the first embodiment, the groove hole 161*a* serving as a rotation limiter may be regarded as a recess while the stopper pin 162 serving as a movable member may be regarded as a protrusion, and rotation of the rotating member (i.e., flange 161) is restricted through engagement of the protrusion with the recess. However, the relationship between the recess and the protrusion may be reversed. Namely, a protrusion may be formed on one of two members whose rotation is to be restricted, and a recess may be formed on the other member that restricts rotation of the above-indicated one member. Also, rotation of the rotating member may be restricted or inhibited through interference between two protrusions. While the rotating member (i.e., flange 161) is provided on the camshaft 151 in the first embodiment, the camshaft 151 itself may be used as a rotating member. Furthermore, a member provided in a motion transmission path that extends from the electric motor to the cams, other than the camshaft, may be used as a rotating member. It is also possible to restrict rotation of the cams by restricting movement of a member provided in a motion transmission path that extends from the electric motor to the valves, even if the movement of the member is in the form of linear motion rather than rotary motion. In sum, any mechanism suffices if it can physically restrict the angle of rotation of the camshaft within a predetermined angular range. These modifications may also be applied to the second embodiment. For example, various modified examples or forms of the rotational angle restricting mechanism as shown in FIG. 12 through FIG. 16 may be employed.

Figure 12:
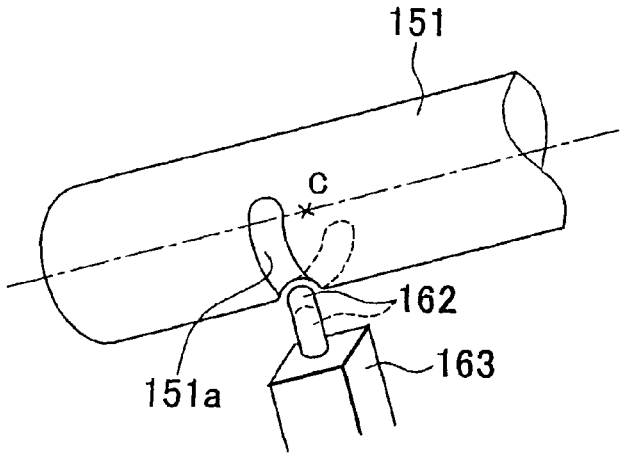
FIG. 12 is a view showing the first example of various forms of rotational angle restricting mechanisms.

In the example as shown in FIG. 12, the camshaft 151 serves as a rotating member, and a curved groove 151*a* serving as a rotation limiter (groove portion) is formed in the outer circumferential surface of the camshaft 151. The curved groove 151*a* is located at the radially outer side from the center C of rotation of the camshaft 151, and has dimensions that allow insertion of the stopper pin 162 thereinto. The construction of the hydraulic mechanism 163 for driving the stopper pin 162 may be similar to that of the first embodiment as shown in FIG. 1. The rotational angle restricting mechanism thus constructed is able to provide substantially the same function as that of the embodiment of FIG. 1. It is to be noted that the position of the stopper pin 162 indicated by a solid line in FIG. 12 is the restricting position, and the position indicated by a broken line in FIG. 12 is the non-restricting position.

Figure 13A:
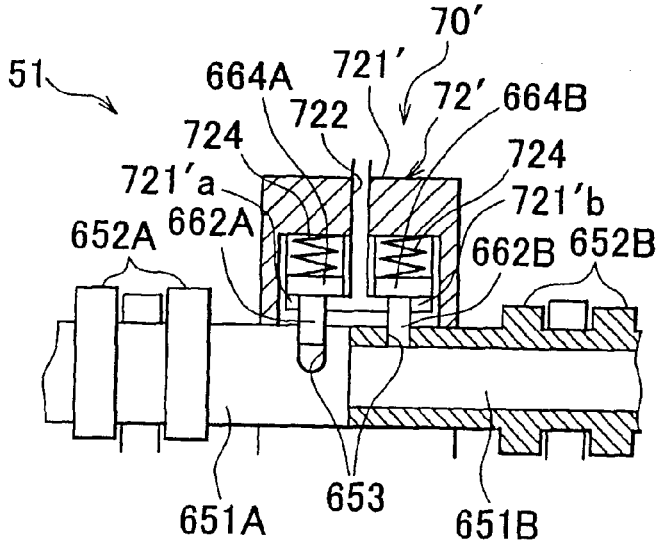
FIG. 13A is a view showing a modified example of the second embodiment employing the rotational angle restricting mechanism of FIG. 12, in particular, showing a condition in which the restricting mechanism is placed in the restricting position.
Figure 13B:
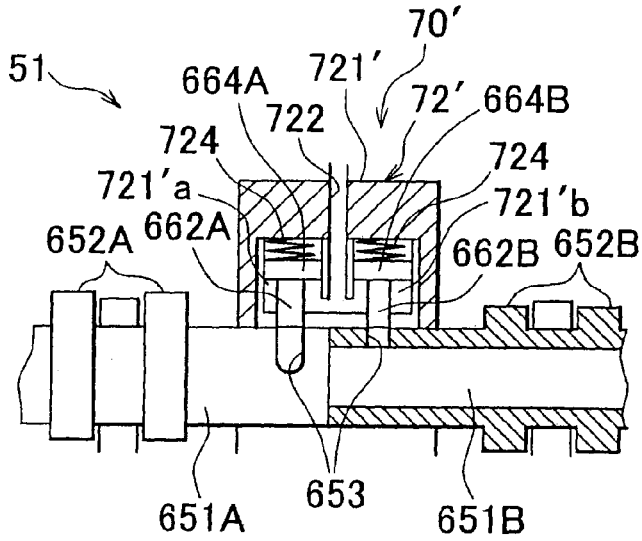
FIG. 13B is a view showing the modified example of the second embodiment employing the rotational angle restricting mechanism of FIG. 12, in particular, showing a condition in which the restricting mechanism is placed in the non-restricting position.

The rotational angle restricting mechanism as shown in FIG. 12 may be employed in the system as shown in FIG. 13A and FIG. 13B. FIG. 13A and FIG. 13B illustrate a modified example of the second embodiment as shown in FIG. 6, and FIG. 13A illustrates a condition of the rotational angle restricting mechanism when placed in the restricting position while FIG. 13B illustrates a condition of the restricting mechanism when placed in the non-restricting position. In the following explanation, the same reference numerals as used in FIG. 6 are used for identifying the same or corresponding elements or components, of which no further explanation is provided. In this modified example, a rotational angle restricting unit 70' includes a hydraulic mechanism 72' that is operable to move each of the stopper pins 662A, 662B in a direction perpendicular to the axis of each of the camshafts 651A, 651B. Curved grooves 653 serving as rotation limiters (groove portions) are respectively formed in the outer circumferential surface of the camshaft 651A and the outer circumferential surface of the camshaft 651B, and each of the camshafts 651A, 651B serves as a rotating member. An oil pressure chamber 721'*a* that contains the stopper pin 662A and an oil pressure chamber 721'*b* that contains the stopper pin 662B are formed in a housing 721'. The modified example thus constructed functions in a manner similar to the second embodiment. In the modified example, in particular, a dimension of the rotational angle restricting unit 70' as measured in a direction parallel with the axis of the camshafts 651A, 651B can be made smaller than that of the rotational angle restricting unit 70 of the second embodiment.

Figure 14:
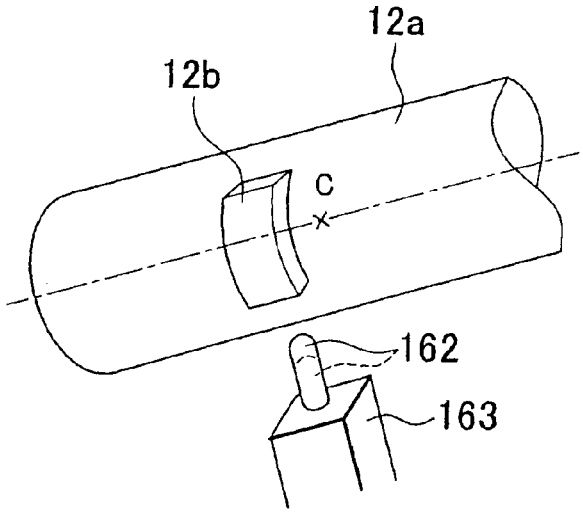
FIG. 14 is a view showing the second example of various forms of rotational angle restricting mechanisms.

In the example as shown in FIG. 14, the output shaft 12*a* of the electric motor 12 serves as a rotating member, and a protrusion 12*b* serving as a rotation limiter is formed on the periphery of the output shaft 12*a*. The construction of the hydraulic mechanism 163 for driving the stopper pin 162 may be similar to that of the first embodiment as shown in FIG. 1. The dimensions of the protrusion 12*b* are suitably adjusted so that the rotational angle of the camshaft 151 can be restricted within a desired range. Thus, the rotational angle restricting mechanism of FIG. 14 provides substantially the same function as that of the embodiment as shown in FIG. 1. In the example of FIG. 14, however, the ratio of the speeds of the camshaft 151 and the output shaft 12*a* of the electric motor 12 needs to be taken into consideration when the dimensions of the protrusion 12*b* are determined. In the case where the speed of rotation of the camshaft 151 is lower than that of the output shaft 12*a* of the electric motor 12, the length of the protrusion 12*b* as measured in the circumferential direction needs to be increased in accordance with the speed ratio. If the protrusion 12*b* extends over the entire circumference of the output shaft 12*a* as a result of the increase of the length of the protrusion 12*b*, this example cannot be put into practice. The second embodiment of the invention may be modified by constructing the output shaft of the electric motor as shown in FIG. 14, to provide a rotational angle restricting mechanism that replaces the rotational angle restricting unit 70.

Figure 15:
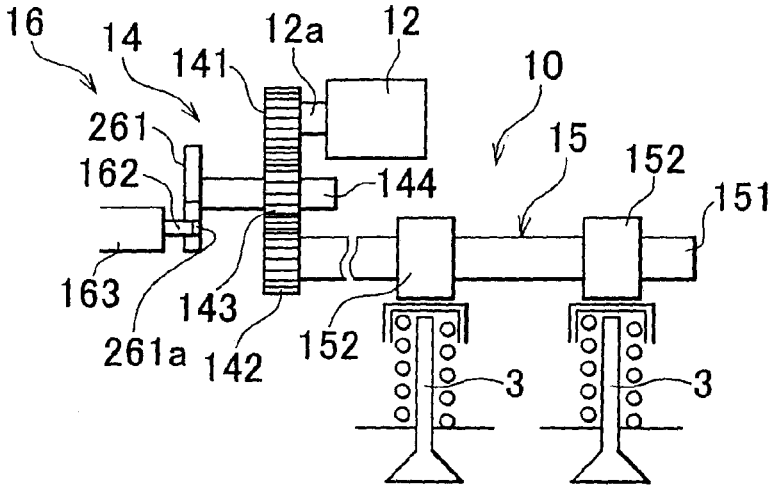
FIG. 15 is a view showing a third example of various forms of rotational angle restricting mechanisms.

In the example as shown in FIG. 15, the gear train 14 of the power transmitting mechanism 13 has an intermediate gear 143 that is disposed between the motor gear 141 and the cam drive gear 142 and meshes with these gears 141, 142, and an intermediate shaft 144 that rotates as a unit with the intermediate gear 143 is provided. A flange 261 serving as a rotating member is provided on the intermediate shaft 144, and a slotted groove hole 261*a* serving as a rotation limiter is formed in the flange 261 such that the groove hole 261*a* is located at the radially outer side from the center of rotation of the flange 261. If the speed ratio of the intermediate shaft 144 and the camshaft 151 is equal to 1, the construction or configuration of the flange 261 and the groove hole 261*a* may be respectively identical with those of the first embodiment as shown in FIG. 1 and FIG. 2. If the speed ratio is not equal to 1, the width (or angle) of the groove hole 261*a* as measured in the circumferential direction needs to be adjusted in view of the speed ratio. Also, the intermediate shaft 144 itself may be used as a rotating member, as in the example of FIG. 12, and a curved groove similar to that of FIG. 12 may be formed as a rotation limiter in the intermediate shaft 144. Also, a protrusion similar to that of FIG. 14 may be provided as a rotation limiter on the intermediate shaft 144. In these examples, the hydraulic mechanism 163 for driving the stopper pin 162 may be similar in construction to that of the embodiment of FIG. 1. With the above arrangements, the rotational angle of the intermediate shaft 144 is restricted, whereby the rotational angle of the camshaft 151 is also restricted. Thus, the rotational angle restricting mechanism of FIG. 15 provides substantially the same function as that of the embodiment as shown in FIG. 1.

Figure 16:
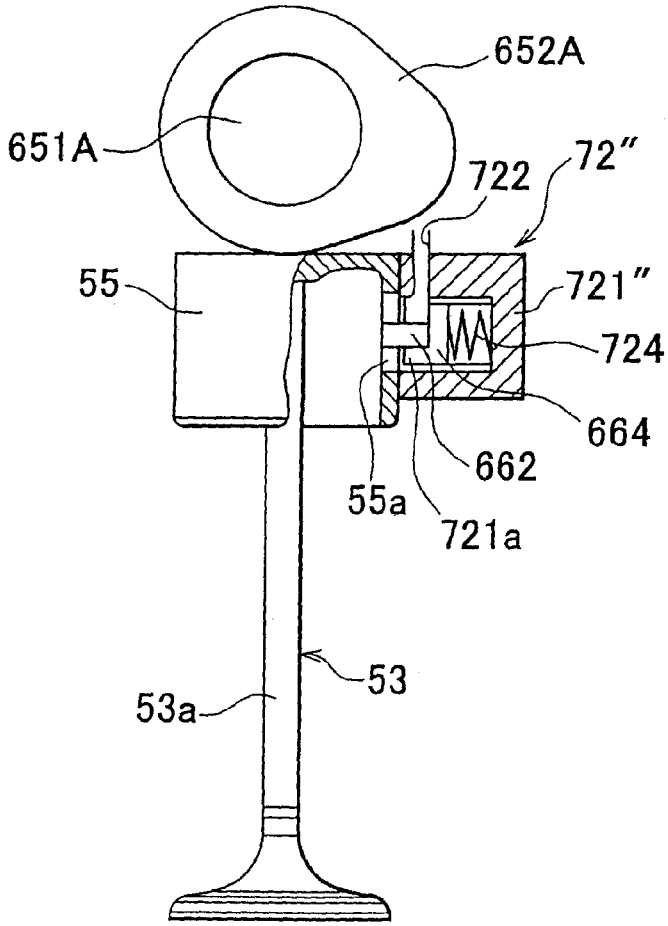
FIG. 16 is a view showing a fourth example of various forms of rotational angle restricting mechanisms.

The example as shown in FIG. 16 is a modified example of the second embodiment. In FIG. 16, the structure in which the intake valve 53 is driven by the cam 652A is illustrated by way of example. In the example of FIG. 16, a groove hole 55*a* serving as a motor limiter is formed in a side face of the valve lifter 55 as an intervening member, and the stopper pin 662 is arranged to be inserted into the groove hole 55*a*. In operation, the stopper pin 662 is advanced into and retracted from the groove hole 55*a*, to thus provide a rotational angle restricting mechanism. A hydraulic mechanism 72", which is similar to the hydraulic mechanism 72 of the rotational angle restricting unit 70, is operable to move the stopper pin 662 between the restricting position and the non-restricting position. More specifically, the hydraulic mechanism 72" includes a housing 721" in which an oil pressure chamber 721*a* that contains the stopper pin 662 is formed, and the stopper pin 662 is biased toward the restricting position under compression reaction force of a spring 724 as an biasing means. With this arrangement, when the supply passage 722 is opened by a solenoid-operated valve (not shown), hydraulic pressure is supplied to the oil pressure chamber 721*a*, and acts on the piston portion 664 of the stopper pin 662. As a result, the stopper pin 662 moves from the restricting position to the non-restricting position against the reaction force of the spring 724. When the supply passage 722 is closed by the solenoid-operated valve, on the other hand, supply of the hydraulic pressure is inhibited, so that the stopper pin 662 moves from the non-restricting position to the restricting position under the compression reaction force of the spring 724. When the stopper pin 662 is inserted into the groove hole 55*a* of the valve lifter 55, the range of movement of the valve lifter 55 is restricted within the range over which the groove hole 55*a* is formed. As a result, the rotational angle of the cam 652A that contacts with the valve lifter 55 is also restricted in accordance with the restriction on the range of movement of the valve lifter 55. It is thus possible to freely set the range to which the rotation of the cam is restricted by setting the dimension of the groove hole 55*a* as measured in the longitudinal direction (vertical direction in FIG. 16) as desired.

While one rotational angle restricting mechanism is provided for at least one cam in each of the illustrated embodiments, two or more rotational angle restricting mechanisms that restrict the rotational angle of the cam(s) within different angular ranges may be provided. By selectively using these rotational angle restricting mechanisms depending upon the circumstances, the rotational angle of at least one cam can be restricted within various angular ranges. In this case, the angular range within which at least one of the rotational angle restricting mechanisms restricts the rotation of the cams may be set to a range in which the pistons and the intake valves do not interfere with each other. By selecting the rotational angle restricting mechanism having the thus set angular range from the two or more restricting mechanisms, it is possible to avoid valve/piston interference.

The ECU 30 of each of the illustrated embodiments may function as a motor control means for stopping supply of electric current to the electric motor when the current supplied to the electric motor or a physical quantity corresponding to the current exceeds a predetermined value, for the main purpose of preventing a trouble, such as breakage, of the electric motor. This function is often provided in a drive system that drives valves by means of an electric motor. When rotation of the cams is mechanically restricted by the rotational angle restricting mechanism, the driving torque of the electric motor increases. If electric current supplied to the electric motor or a physical quantity corresponding to the current exceeds a predetermined value due to the increase in the driving torque, supply of the current to the electric motor is stopped. Thus, the use of this function is advantageous in that there is no need to separately prepare a control logic or logic circuit for stopping the electric motor, which may be otherwise required upon introduction of the rotational angle restricting mechanism. While the above-mentioned predetermined value may be set as appropriate, it may be set to a value that is about twice as large as the rated current of the electric motor, for example.

Figure 17:
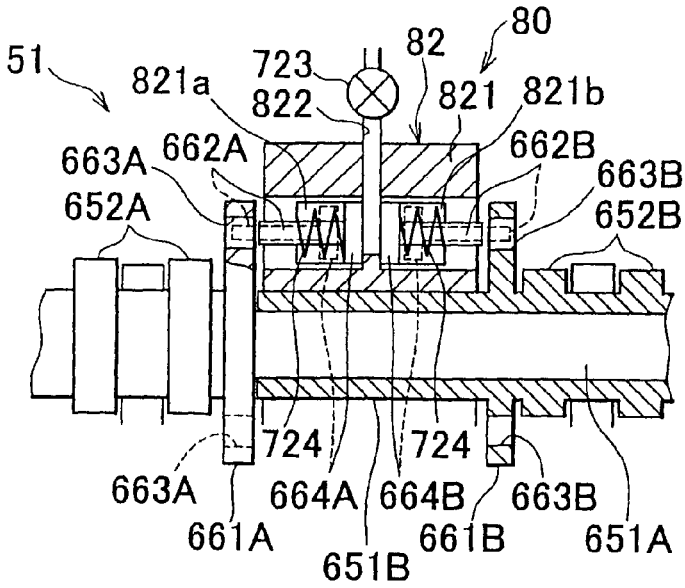
FIG. 17 is a view showing a modified example of the second embodiment in which a hydraulic mechanism that is different from those of the first and second embodiments is employed.

In each of the illustrated embodiment, the hydraulic mechanism effects switching from the restricting position to the non-restricting position when the mechanism allows supply of hydraulic pressure to the oil pressure chamber(s). To the contrary, the hydraulic mechanism may effect switching from the non-restricting position to the restricting position when the mechanism allows the supply of the hydraulic pressure, as shown in FIG. 17 by way of example. The example as shown in FIG. 17 is a modified example of the second embodiment, and the same reference numerals as used in FIG. 6 are used for identifying the same elements or components as those of the second embodiment, and explanation of these elements will not be provided. A hydraulic mechanism 82 of this example is incorporated in a rotational angle restricting unit 80. Each of the stopper pins 662A, 662B is set in the reverse direction with respect to the hydraulic mechanism 72 (FIG. 6), and the spring 724 is arranged to bias each of the stopper pins 662A, 662B in the reverse direction. Thus, each of the stopper pins 662A, 662B is biased by the corresponding spring 724 toward the non-restricting position. The hydraulic mechanism 82 includes a housing 821 in which an oil pressure chamber 821*a* that contains the stopper pin 662A and an oil pressure chamber 821*b* that contains the stopper pin 662B are formed, and a supply passage 882 that communicates with the respective oil pressure chambers 821*a*, 821*b*. The solenoid-operated valve 723 that is identical with that of the first embodiment is provided for opening and closing the supply passage 822, to which hydraulic pressure produced by the engine 51 is supplied. With this arrangement, when the supply passage 822 is opened by the solenoid-operated valve 723, hydraulic pressures are respectively supplied to the oil pressure chambers 821*a*, 821*b*. The hydraulic pressures act on the piston portion 664A of the stopper pin 662A and the piston portion 664B of the stopper pin 662B, respectively, so that each of the stopper pins 662A, 662B moves from the non-restricting position indicated by solid lines in FIG. 17 to the restricting position indicated by broken lines, against the reaction force of the spring 724. When the supply passage 822 is closed by the solenoid-operated valve 723, on the other hand, supply of hydraulic pressure is inhibited or cut off, and, therefore, each of the stopper pins 662A, 662B moves from the restricting position to the non-restricting position under compression reaction force of the spring 724. The hydraulic mechanism 82 thus constructed is suitably employed in an internal combustion engine, such as an engine installed on a hybrid vehicle, which has a high rotational speed at the time of starting, or in an internal combustion engine which operates frequently in a high-speed, high-load region.

Figure 18:
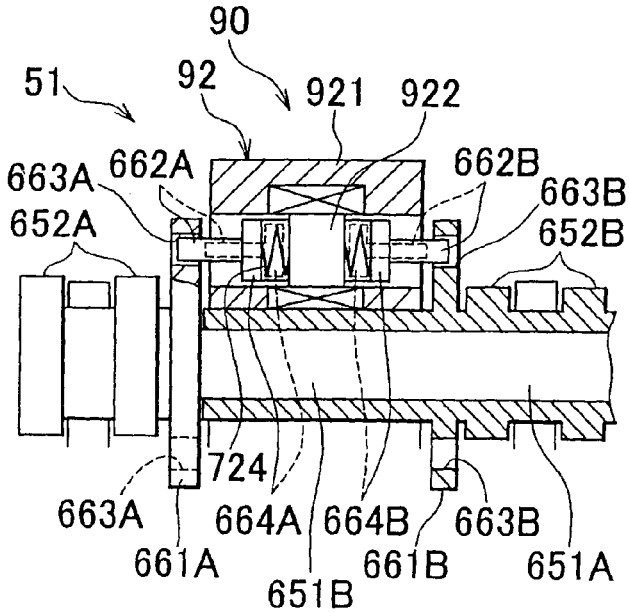
FIG. 18 is a view showing an example of an electromagnetic, driving mechanism that can replace the hydraulic mechanism.

While the hydraulic mechanism 163, 72, 72', 72", 82 which utilizes hydraulic pressure is provided as a means for driving the movable member, any means may be employed provided that it is able to move the movable member. For example, a driving means that utilizes electromagnetic force for moving the movable member between the restricting position and the non-restricting position may be used. One example of the driving means utilizing electromagnetic force is illustrated in FIG. 18. The example of FIG. 18 is a modified example of the second embodiment, and the same reference numerals as used in FIG. 6 are used for identifying the same elements or components as those of the second embodiment, of which no explanation will be provided. An electromagnetic driving mechanism 92 of this example is incorporated in a rotational angle restricting unit 90. Each of the stopper pins 662A, 662B is slidably received in a housing 921 such that the stopper pin 662A, 662B is biased by the corresponding spring 724 toward the restricting position indicated by solid lines in FIG. 18. The housing 921 is provided with a solenoid 922 that produces magnetic force when supplied with electric current. When current is supplied to the solenoid 922, each of the stopper pins 662A, 662B moves from the restricting position to the non-restricting position indicated by broken lines in FIG. 18 against the compression reaction force of the spring 724. If the supply of the current is stopped, on the other hand, each of the stopper pins 662A, 662B moves from the non-restricting position to the restricting position under the compression reaction force of the spring 724. By controlling supply of current to the solenoid 922, the electromagnetic driving mechanism 92 is able to perform substantially the same function as the hydraulic mechanism as described above. In the case where electromagnetic force is utilized as in this example, at least a part of each of the stopper pins 662A, 662B needs to be formed of a magnetic material.

In the second embodiment and its modified examples, the first rotational angle restricting mechanism 66A for restricting rotation of the cams that are driven by the electric motor 62A and the second rotational angle restricting mechanism 66B for restricting rotation of the cams that are driven by the electric motor 62B are integrated into the rotational angle restricting unit 70, 70', 80, 90. It is, however, to be understood that these rotational angle restricting mechanisms 66A, 66B need not be integrated into a single unit, but may be provided as separate structures, which respectively function as rotational angle restricting mechanisms.

While the above explanation is concerned with the variable valve actuating mechanisms exclusively in charge of opening and closing the intake valves, the above explanation may also be applied to variable valve actuating mechanisms in charge of opening and closing exhaust valves (not shown). Thus, through application of the invention to a variable valve actuating mechanism for exhaust valves, the rotational angle of cams that drive the exhaust valves can be restricted. Also, if the variable valve actuating mechanism in charge of opening and closing the exhaust valves is constructed similarly to that of the first or second embodiment, interference between the pistons and the exhaust valves can be avoided.

While the invention has been described with reference to exemplary embodiments thereof, it is to be understood that the invention is not limited to the exemplary embodiments or constructions. To the contrary, the invention is intended to cover various modifications and equivalent arrangements. In addition, while the various elements of the exemplary embodiments are shown in various combinations and configurations, which are exemplary, other combinations and configurations, including more, less or only a single element, are also within the scope of the invention.

The invention claimed is:

1. A valve driving method comprising:

converting rotary motion of an electric motor into opening and closing motion of a valve provided in a cylinder of an internal combustion engine to transmit power from the electric motor to the valve via a cam; and mechanically restricting rotation of the cam within a predetermined angular range that is set so that the valve and a piston disposed in the engine do not interfere with each other, the restricting rotation being carried out with a restricting mechanism provided in a motion transmission path that extends from the electric motor to the valve.

2. The valve driving method according to claim 1, wherein the predetermined angular range is narrower than an angular range in which the cam provides the maximum lift of the valve.

3. The valve driving method according to claim 1, further comprising stopping supply of electric current to the electric motor when the driving torque of the electric motor exceeds a predetermined value.

4. A valve drive system comprising:

a power transmitting mechanism that converts rotary motion of an electric motor into opening and closing motion of a valve provided in a cylinder of an internal combustion engine to transmit power from the electric motor to the valve via a cam; and a rotational angle restricting mechanism that is provided in a motion transmission path that extends from the electric motor to the valve, and restricts rotation of the cam within a predetermined angular range that is narrower than an angular range in which the cam provides the maximum lift of the valve.

5. A valve drive system according to claim 4, wherein:

the internal combustion engine has a plurality of cylinders and valves, the valves being disposed in the respective cylinders, the power transmitting mechanism has a plurality of cams that drive the respective plurality of valves, the electric motor has the first electric motor that is served as a driving source of at least one of the plurality of cams and the second electric motor that is served as a driving source of the remainder of the plurality of cams, and the rotational angle restricting mechanism comprises a rotational angle restricting unit that is an integrated assembly of the first rotational angle restricting mechanism that restricts rotation of the at least one of the plurality of cams driven by the first electric motor within the predetermined angular range, and the second rotational angle restricting mechanism restricts rotation of the remainder of the plurality of cams driven by the second electric motor within the predetermined angular range.

6. A valve drive system according to claim 4, wherein:

the power transmitting mechanism has an intervening member that is interposed between the cam and the valve and that moves in synchronization with the opening and closing motion of the valve, and the rotational angle restricting mechanism comprises a motion limiter that is provided in the intervening member, and a movable member that moves between a restricting position at which the movable member interferes with a passage range of the motion limiter and a non-restricting position at which the movable member is located away from the passage range of the motion limiter.

7. A valve drive system according to claim 4, further comprising a motor control portion that stops supply of electric current to the electric motor when the current supplied to the electric current or a physical quantity corresponding to the current exceeds a predetermined value as driving torque of the electric motor increases.

8. A valve drive system according to claim 4, wherein:

the internal combustion engine has a plurality of cylinders and valves, the valves being disposed in the respective cylinders;

a plurality of cams are provided for driving the respective plurality of valves, and the power transmitting mechanism is arranged to convert rotary motion of the electric motor into opening and closing motion of the plurality of valves to transmit power from the electric motor to the valves via the plurality of cams, and the rotational angle restricting mechanism is arranged to restrict rotation of the plurality of cams.

9. A valve drive system according to claim 4, wherein the rotational angle restricting mechanism comprises a plurality of rotational angle restricting mechanisms, at least two of the plurality of rotational angle restricting mechanisms having the different predetermined angular ranges.

10. A valve drive system according to claim 9, wherein the predetermined angular range of at least one of the plurality of rotational angle restricting mechanisms is set so that the valve and a piston disposed in the engine do not interfere with each other.

11. A valve drive system according to claim 4, wherein: the internal combustion engine is installed on a vehicle to serve as a power source for driving, the valve drive system further comprises a motor control portion that executes a restricting oscillation mode for restricting a lift of the valve by oscillating the cam within an oscillation range less than one rotation, so that the vehicle runs under a limp-home mode in which the running speed of the vehicle is restricted when an abnormality occurs in the engine, and the predetermined angular range is set to an angular range that is larger than the oscillation range.

12. A valve drive system according to claim 11, wherein:

the internal combustion engine has a plurality of cylinders and valves, the valves being disposed in the respective cylinders, and the oscillation range of the restricting oscillation mode is set so that when an abnormality occurs in at least one of the plurality of cylinders the vehicle runs under the limp-home mode while halting only the at least one of the plurality of cylinders in which the abnormality occurs.

13. A valve drive system according to claim 4, wherein:

the internal combustion engine is installed on a vehicle to serve as one of a plurality of power sources for driving, and the vehicle is arranged to be able to run only with one or more of the power sources other than the engine, and the rotational angle restricting mechanism restricts rotation of the cam so as to stop the valve at a predetermined position.

14. A valve drive system according to claim 13, wherein the rotational angle restricting mechanism restricts rotation of the cam so as to stop the valve at a position at which the valve is fully closed or at a position at which a lift of the valve is equal to or larger than a predetermined amount.

15. A valve drive system according to claim 4, further comprising a restricting mechanism control portion that controls the rotational angle restricting mechanism so as to restrict rotation of the cam within the predetermined angular range when the cam does not rotate in synchronization with a crankshaft of the engine.

16. A valve drive system according to claim 15, further comprising a motor control portion that controls the electric motor under a selected one of a plurality of modes including a restricting oscillation mode for oscillating the cam within the predetermined angular range, a normal oscillation mode for oscillating the cam beyond the predetermined angular range, and a normal rotation mode for rotating the cam in one direction, wherein the motor control portion selects and executes the restricting oscillation mode when the cam does not rotate in synchronization with a crankshaft of the engine.

17. A valve drive system according to claim 4, wherein the rotational angle restricting mechanism comprises:

a rotation limiter that is provided on a rotating member disposed in the motion transmission path, the rotation limiter being located at the radially outer side from a rotation center of the rotating member; and a movable member that moves between a restricting position at which the movable member interferes with a passage range of the rotation limiter and a non-restricting position at which the movable member is located away from the passage range of the rotation limiter.

18. A valve drive system according to claim 17, wherein the rotational angle restricting mechanism further comprises an electromagnetic driving mechanism that moves the movable member between the restricting position and the non-restricting position by utilizing electromagnetic force.

19. A valve drive system according to claim 17, wherein the power transmitting mechanism has a camshaft on which the cam is provided, and the rotational angle restricting mechanism is arranged to move the movable member in a direction parallel with the axis of the camshaft.

20. A valve drive system according to claim 17, wherein the power transmitting mechanism has a camshaft on which the cam is provided, and the rotational angle restricting mechanism is arranged to move the movable member in a direction perpendicular to the axis of the camshaft.

21. A valve drive system according to claim 17, wherein the rotational angle restricting mechanism further comprises a hydraulic mechanism that moves the movable member between the restricting position and the non-restricting position by utilizing hydraulic pressure generated in accordance with an operation of the engine.

22. A valve drive system according to claim 21, wherein the hydraulic mechanism comprises a biasing device that biases the movable member toward the restricting position, and moves the movable member from the restricting position to the non-restricting position by supplying the hydraulic pressure.

23. A valve drive system according to claim 21, wherein the hydraulic mechanism includes a biasing device that biases the movable member toward the non-restricting position, and moves the movable member from the non-restricting position to the restricting position by supplying the hydraulic pressure.

24. A valve drive system comprising:

a power transmitting mechanism that converts rotary motion of an electric motor into opening and closing motion of a valve provided in a cylinder of an internal combustion engine to transmit power from the electric motor to the valve via a cam; and a rotational angle restricting mechanism that is provided in a motion transmission path that extends from the electric motor to the cam, and restricts rotation of the cam within a predetermined angular range that is set so that the valve and a piston disposed in the engine do not interfere with each other.

25. A valve drive system according to claim 24, further comprising a restricting mechanism control portion that controls the rotational angle restricting mechanism so as to restrict rotation of the cam within the predetermined angular range when the cam does not rotate in synchronization with a crankshaft of the engine.

26. A valve drive system according to claim 24, wherein:

the internal combustion engine has a plurality of cylinders and valves, the valves being disposed in the respective cylinders;

a plurality of cams are provided for driving the respective plurality of valves;

the power transmitting mechanism is arranged to convert rotary motion of the electric motor into opening and closing motion of the plurality of valves to transmit power from the electric motor to the valves via the plurality of cams; and the rotational angle restricting mechanism is arranged to restrict rotation of the plurality of cams.

27. A valve drive system according to claim 24, wherein the rotational angle restricting mechanism comprises:

a rotation limiter that is provided in a rotating member disposed in the motion transmission path, the rotation limiter being located at the radially outer side from a rotation center of the rotating member; and a movable member that moves between a restricting position at which the movable member interferes with a passage range of the rotation limiter and a non-restricting position at which the movable member is located away from the passage range of the rotation limiter.

28. A valve drive system according to claim 27, wherein the rotational angle restricting mechanism further comprises a hydraulic mechanism that moves the movable member between the restricting position and the non-restricting position by utilizing hydraulic pressure generated in accordance with an operation of the engine.

29. A valve drive system according to claim 27, wherein the rotational angle restricting mechanism further comprises an electromagnetic driving mechanism that moves the movable member between the restricting position and the non-restricting position by utilizing electromagnetic force.

30. A valve drive system according to claim 27, wherein the power transmitting mechanism has a camshaft on which the cam is provided, and the rotational angle restricting mechanism is arranged to move the movable member in a direction parallel with the axis of the camshaft.

31. A valve drive system according to claim 27, wherein the power transmitting mechanism has a camshaft on which the cam is provided, and the rotational angle restricting mechanism is arranged to move the movable member in a direction perpendicular to the axis of the camshaft.

32. A valve drive system according to claim 27, wherein the power transmitting mechanism has a camshaft on which the cam is provided, and the rotating member rotates as a unit with the camshaft.

33. A valve drive system according to claim 32, wherein the rotation limiter comprises a groove portion that is formed on the rotating member so as to extend in a circumferential direction of the rotating member, the groove portion having dimensions that allow insertion of the movable member thereinto.

34. A valve drive system according to claim 27, wherein:

the electric motor has an output shaft, and the power transmitting mechanism has a camshaft on which the cam is provided; and at least one of the output shaft and the camshaft serves as the rotating member.

* * * * *